US010702434B2

(12) United States Patent
Corona et al.

(10) Patent No.: US 10,702,434 B2
(45) Date of Patent: Jul. 7, 2020

(54) GROSSING STATION SYSTEM

(71) Applicant: MP Acquisition, LLC, Oak Park, MI (US)

(72) Inventors: Massimo Corona, Livonia, MI (US); Mohamed Simo Meskouri, Bloomfield, MI (US)

(73) Assignee: MP Acquisition, LLC, Oak Park, MI (US)

( * ) Notice: Subject to any disclaimer, the term of this patent is extended or adjusted under 35 U.S.C. 154(b) by 335 days.

(21) Appl. No.: 15/626,555

(22) Filed: Jun. 19, 2017

(65) Prior Publication Data

US 2017/0360639 A1 Dec. 21, 2017

Related U.S. Application Data

(60) Provisional application No. 62/352,058, filed on Jun. 20, 2016.

(51) Int. Cl.

| | |
|---|---|
| ***A61G 13/00*** | (2006.01) |
| ***G08B 25/10*** | (2006.01) |
| ***G08B 3/10*** | (2006.01) |
| ***A61G 13/04*** | (2006.01) |
| ***A61G 13/10*** | (2006.01) |
| ***G08B 23/00*** | (2006.01) |
| ***A61G 13/06*** | (2006.01) |
| ***F24F 7/00*** | (2006.01) |
| ***G08B 5/02*** | (2006.01) |

(52) U.S. Cl.

CPC ..... *A61G 13/0027* (2013.01); *A61G 13/04* (2013.01); *A61G 13/102* (2013.01); *A61G 13/108* (2013.01); *G08B 3/10* (2013.01); *G08B 23/00* (2013.01); *G08B 25/10* (2013.01); *A61G 13/06* (2013.01); *F24F 2007/001* (2013.01); *G08B 5/02* (2013.01)

(58) Field of Classification Search

CPC ..... A61G 13/0027; A61G 13/108; A61G 13/102; A61G 13/04; A61G 13/06; G08B 25/10; G08B 3/10; G08B 23/00; G08B 5/02; F24F 2007/001

See application file for complete search history.

(56) References Cited

U.S. PATENT DOCUMENTS

| | | | |
|---|---|---|---|
| 2,512,747 | A | 6/1950 | Lewis |
| 2,702,505 | A | 2/1955 | Nelson |
| 3,799,534 | A | 3/1974 | Coles |
| 3,874,754 | A | 4/1975 | Saunders et al. |
| 4,038,974 | A | 8/1977 | Pielkenrood |
| 4,140,105 | A | 2/1979 | Duvlis |
| 4,402,144 | A | 9/1983 | Dumke |
| 4,422,369 | A | 12/1983 | Smets |

(Continued)

*Primary Examiner* — Myles A Throop

(74) *Attorney, Agent, or Firm* — Raggio & Dinnin, P.C.

(57) ABSTRACT

A grossing station comprising a table and an overhead hood connected to the table. The grossing station further comprising a plurality of interchangeable plates arranged in a trough of the table and a lift system connected to the table. The grossing station also comprises a touch screen controller arranged on a surface of the station, wherein the touch screen controller is in communication with at least one manual toggle switch for overriding an electronic control and monitoring system if a system failure occurs within the grossing station.

20 Claims, 24 Drawing Sheets

(56) References Cited

U.S. PATENT DOCUMENTS 4,650,171 A 3/1987 Howorth
4,876,773 A 10/1989 Wade
4,898,089 A 2/1990 Roos
4,901,410 A 2/1990 Fischer et al.
4,980,956 A 1/1991 Fischer et al.
5,042,456 A 8/1991 Cote
5,093,969 A 3/1992 McGuire
5,181,883 A 1/1993 Hofstra et al.
5,244,433 A 9/1993 Utterback
5,303,659 A 4/1994 Berlin et al.
5,620,407 A 4/1997 Change
5,621,929 A 4/1997 Smith
5,904,162 A 5/1999 Ferguson et al.
6,050,660 A 4/2000 Gurley
6,082,392 A * 7/2000 Watkins, Jr. ..... B67D 7/002 137/312
6,162,269 A * 12/2000 Greenlees ..... F01P 11/12 123/198 E
6,279,510 B1 8/2001 Batterton
6,382,272 B1 * 5/2002 Dahlin ..... B60P 3/14 137/351
6,694,892 B2 2/2004 Lin et al.
7,428,882 B2 9/2008 Keil
7,468,161 B2 12/2008 Reinhardt et al.
9,188,355 B1 * 11/2015 Allen ..... F24F 11/77
9,463,129 B2 * 10/2016 Hallman ..... A61G 13/0027
2003/0033790 A1 2/2003 Hague
2005/0062594 A1 * 3/2005 Takashima ..... G01F 23/74 340/450.2
2005/0160948 A1 7/2005 Irwin
2006/0154590 A1 7/2006 Kanaya
2006/0180057 A1 8/2006 Hallman
2008/0202491 A1 8/2008 Eberhand
2008/0238323 A1 * 10/2008 Chan ..... H05K 1/189 315/35
2009/0108128 A1 * 4/2009 Mann, III ..... B64F 1/364 244/58
2010/0164736 A1 * 7/2010 Byers ..... H04L 12/12 340/657
2012/0037049 A1 2/2012 Martin et al.
2012/0221152 A1 * 8/2012 Portocalis ..... B67D 7/08 700/283
2012/0260418 A1 10/2012 Rundberg et al.
2012/0318138 A1 * 12/2012 Bisson ..... B01D 46/0086 95/25
2013/0074261 A1 * 3/2013 Hallman ..... A61G 13/0027 5/600
2015/0079894 A1 3/2015 Zimmerman
2016/0128880 A1 * 5/2016 Blickensderfer .... A61G 1/0212 296/20
2017/0087040 A1 3/2017 Hallman

* cited by examiner

GROSSING STATION SYSTEM

This application claims the benefit of U.S. Provisional Patent Application 62/352,058—Filed: Jun. 20, 2016

BACKGROUND OF THE INVENTION

1. Field of the Invention

The present invention generally relates to an autopsy table, and more particularly relates to a grossing station having components that improve the user's experience when using the grossing station.

2. Description of Related Art

Autopsy tables, grossing tables, necropsy tables and trimming tables are all well known in the art. These tables are designed to accommodate a body or other part of a body while a post-mortem examination is carried out or pathology is conducted on an organ or other body part. Many of these autopsy tables and/or grossing stations in the prior art are made of simple ceramic slabs with no exhaust systems. Recently, these prior art autopsy tables have been made of stainless steel having a discontinuous or perforated surface. These tables may have ventilation systems to reduce the odor associated with chemical, natural fluids and components that are associated with an autopsy or pathology procedure. The use of ceramic slabs or stainless steel created an easy to clean surface that generally are non porous and easy to disinfect after each autopsy or pathology procedure is conducted.

Many of the prior art autopsy stations include an assortment of components used in conjunction therewith. For instance, an autopsy station may include a plurality of faucets that are used for transferring liquids, gas, or vapors to the autopsy station. Such liquids can be formaldehyde, other chemicals, water, or any other type of chemical or substance needed during an autopsy or pathology procedure. The autopsy tables of the prior art generally also include an air system that includes an air intake and air exhaust vents that may also include filters and the like to constantly clean the air and reduce odors from the autopsy table and surrounding environment. Furthermore, sinks are generally located within an autopsy table. Grating surfaces may also be located on the autopsy table for allowing fluids to be removed and collected during an autopsy of a human or animal body. Furthermore, autopsy tables may also be arranged such that a gurney or cart may be used in conjunction with the autopsy table or grossing station for delivering the body or for holding the body during the autopsy procedure. The gurney or cart may be capable of being secured in position against a predetermined surface of an autopsy table and may also be inclined to any required angle necessary for the user performing the autopsy.

Prior art autopsy tables have generally been used in fixed positions in a post mortem room, hospital, laboratory or the like. Furthermore, these tables generally are fixed in a position that is convenient for a predetermined average size human to conduct the work of the autopsy or pathology procedures in a comfortable, non-stress inducing manner in a standing or seated position.

One possible problem associated with prior art autopsy, necropsy, grossing stations or tables is that they are fixed at a single height and are not adjustable to provide an ergonomically friendly use for people of various heights. Another potential problem with prior art autopsy tables may be that many of them do not have a blower and ventilation system. Furthermore, another problem in the prior art maybe that an autopsy table that uses formalin or formaldehyde in an autopsy or necropsy procedure will not have an integrated system for storing and using the formalin, formaldehyde or other autopsy liquids during use thereof. Furthermore, many of these prior art autopsy tables are not capable of being adjusted to various heights. Also, many prior art autopsy tables do not include a predetermined stainless steel top with a perforated section. arranged thereon without any ability to interchange or use different configurations for the autopsy table. Furthermore, many of these prior art autopsy tables do not include filter hour meters that act in real time, an eco mode which allows for the reduction in energy use for the autopsy table, a remote warning system, a low CFM warning system, an alarm configuration protocol, improved reliability, a system that allows for redundant control of systems, improved lighting systems or a formalin refill system for use with a grossing station.

Therefore, there is a need in the art for an improved grossing station that is capable of having a real time filter hour meter arranged therewith. There also is a need in the art for a grossing station that includes an eco mode that may automatically turn off lights and other systems including ventilation when a user steps away from the grossing station. There is also a need in the art for a remote warning system that will remotely warn users of the grossing station or others in the vicinity of the grossing station that a formalin tank is full, a filter needs replacement or the air flow monitor is having an issue. There also is a need in the art for a grossing station that has a low CFM warning system, such that the grossing station monitors the air flow rate in cubic feet per minute (CFM) and allows for the user to input a lower threshold that may set an alarm if the CFM drops below the low limit. There also is a need in the art for a grossing station that has an alarm system that is configurable to specific alarm sounds, matings, and notifications. There also is a need in the art for a grossing station that increases the reliability of the grossing station through use of a touch screen controller and system redundancy built therein. There also is a need in the art for a grossing station that has an improved lighting strategy that focuses on light temperature, work area light coverage and shadow reduction. Furthermore, there is a need in the art for a formalin refill system for a grossing station that is easy to use and environmentally friendly.

SUMMARY OF THE INVENTION

One object of the present invention may be to provide a novel and unique grossing station.

Another object of the present invention may be to provide a grossing station that has a filter hour meter.

Another object of the present invention may be to provide a grossing station that has a configurable air flow base trigger hour meter.

Still another object of the present invention may be to provide a grossing station that includes an eco mode system that would detect the presence of individuals in proximity of the grossing station.

Still another object of the present invention may be to provide a grossing station that includes a remote warning system that monitors a formalin tank and displays a warning indicator on the station when the tank is empty.

Yet another object of the present invention may be to provide a grossing station that includes a low CFM warning system that monitors the air flow rate CFM and allows the user to input a low threshold limit that can be used to set an alarm if the CFM drops below the predetermined low limit.

Yet another object of the present invention may be to provide a grossing station that includes software that allows users to configure the warnings and alarms to predetermined settings.

Still another object of the present invention may be to provide a grossing station that increases the reliability of the grossing station and improves system robustness by including a manual redundancy to allow the user to manually operate different features of the grossing station.

Yet another object of the present invention may be to provide a grossing station with an improved lighting strategy, which focuses on light temperature, work area light coverage and shadow reduction to increase the grossing station user's experience.

Still another object of the present invention may be to provide a grossing station that uses a formalin refill system.

According to the present invention, the foregoing and other objects and advantages are obtained by a novel design for a grossing station for use in an autopsy, necropsy or pathology procedure. The grossing station comprises a table and an overhead hood connected to the table. The grossing station also comprises a blower and ventilation system arranged on the table. The grossing station may also comprise a plurality of interchangeable plates arranged in a trough to allow for an either left handed or right handed grossing station depending on the user of the grossing station. The grossing station also comprises a lift system to allow for the height of the grossing station to be adjusted. The grossing station also comprises a filter hour meter and an eco mode for use with the grossing station. The grossing station also comprises a remote warning system for use with a formalin system and a low air flow rate CFM warning system. The grossing station also comprises a user configurable alarm setting to allow for individualized and predetermined alarm configurations. The grossing station also comprises a touch screen controller that increases the reliability of the grossing station and also improves the system robustness by including manual redundancy to allow the user to manually operate different features of the grossing station. The grossing station also comprises an improved lighting system that improves the lighting strategy by focusing on light temperature, work area light coverage and shadow reduction for the user. The grossing station also comprises a formalin refill system that includes easy and automatic refill of the formalin system without removal of the formalin tank.

One advantage of the present invention may be that it provides a novel and unique grossing station.

Another advantage of the present invention may be that it provides for a grossing station having a configurable air flow based hour meter.

Still another advantage of the present invention may be that it provides a grossing station that has an eco mode that allows for the grossing station system to detect the presence of individuals in proximity to the grossing station.

Still another advantage of the present invention may be to provide a grossing station that has a remote warning system that monitors a formalin tank and displays a warning indicator on the station when the tank is empty.

Still another advantage of the present invention may be to provide a grossing station that monitors the air flow rate in cubic feet per minute (CFM) and allows the user to input a lower threshold limit that may be used to set an alarm if the CFM drops below the low limit.

Yet another advantage of the present invention may be that it provides for a grossing station that uses software to allow for the user to configure the warnings and alarms to predetermined settings.

Still another advantage of the present invention may be that it provides a grossing station that uses an electrical system with a touch screen controller that also allows for improved system robustness via manual redundancy by allowing the user to manually operate different features of the grossing station in the event of a controller or system failure.

Still another advantage of the present invention may be that it provides a grossing station with an improved lighting system, such that the lighting strategy focuses on light temperature, work area light coverage and shadow reduction for the grossing station user.

Still another advantage of the present invention may be that it includes a formalin refill system that automatically operates and makes it easy to refill multiple stations in one trip, thus reducing formalin exposure to the workers therein.

Other objects, features and advantages of the present invention wall, become apparent from the subsequent description, and appended claims taken in conjunction with the accompany drawings.

DESCRIPTION OF THE EMBODIMENT(S)

Figure 1:
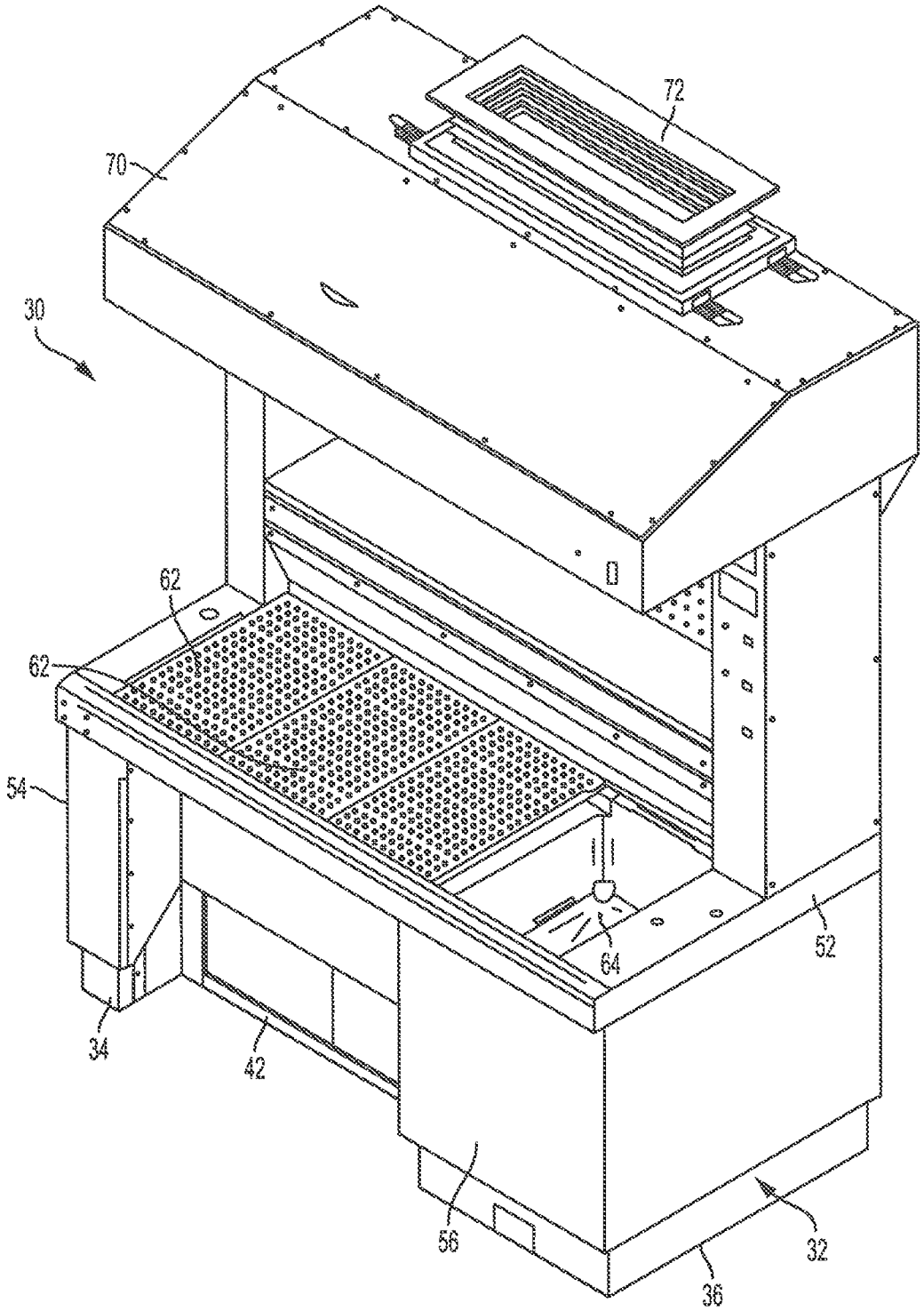
FIG. 1 shows a perspective view of a grossing station according to the present invention.
Figure 2:
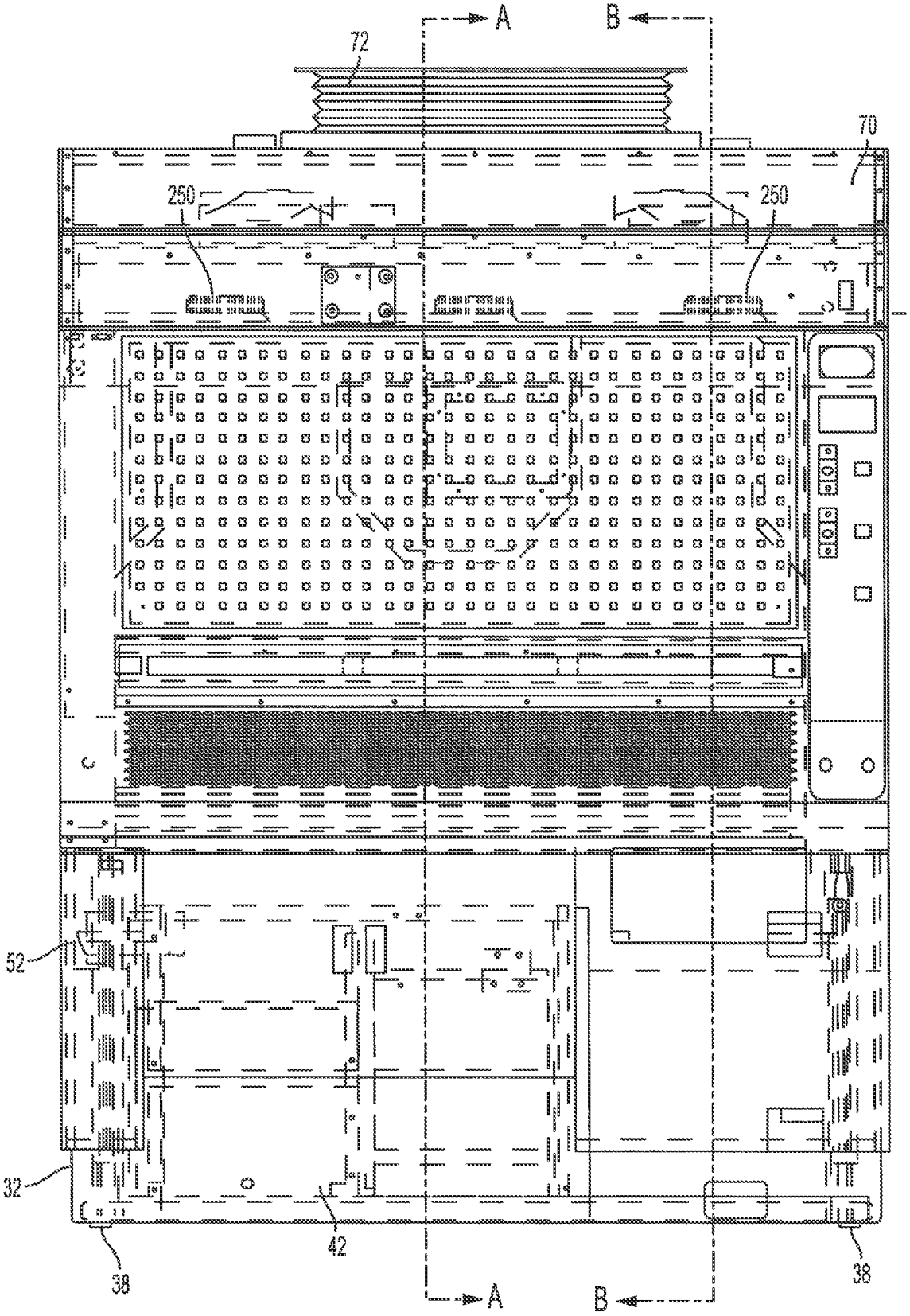
FIG. 2 shows a front view of a grossing station according to the present invention.
Figure 3:
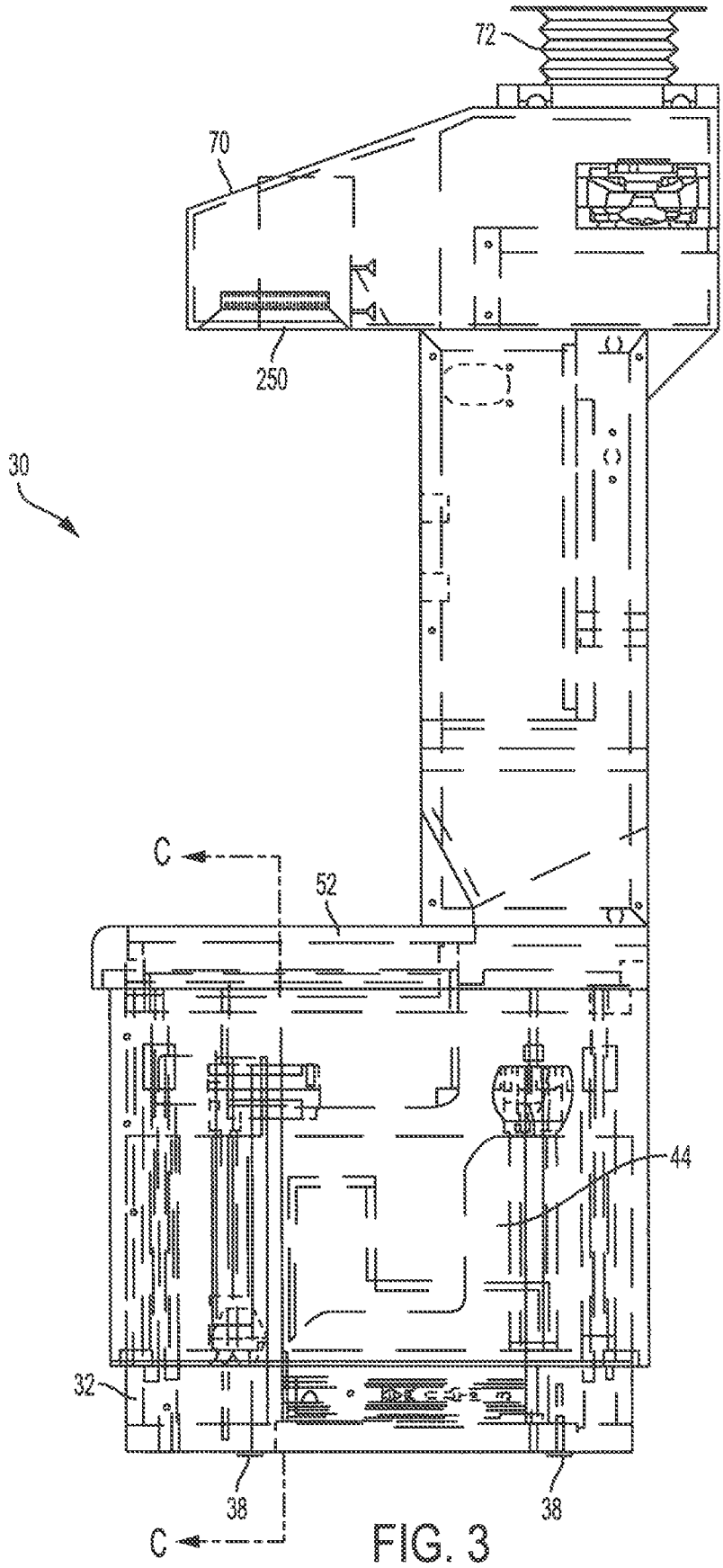
FIG. 3 shows a side view of a grossing station according to the present invention.
Figure 4:
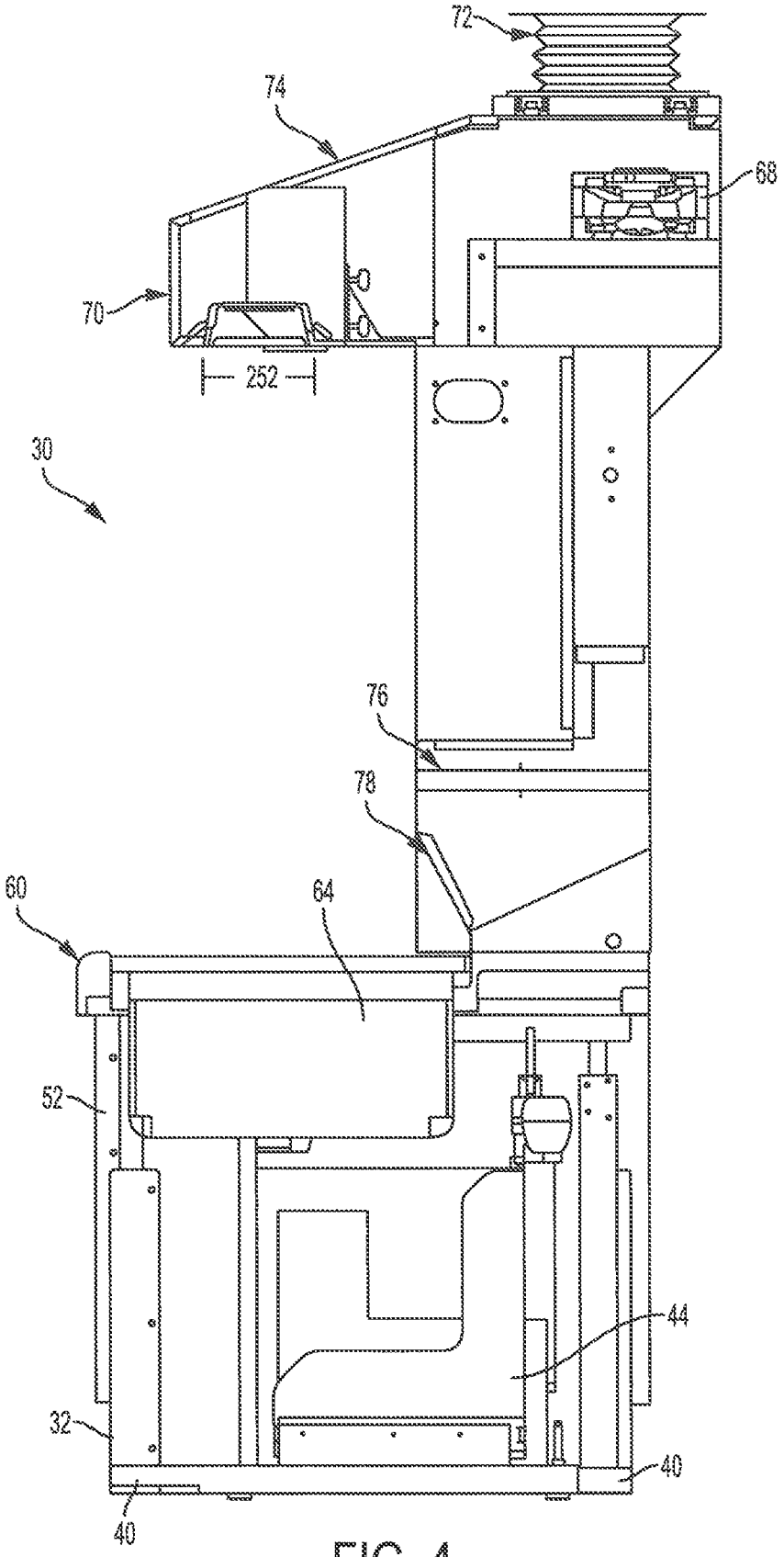
FIG. 4 shows a cross sectional view through line B-B of FIG. 2 of a grossing station according to the present invention.
Figure 5:
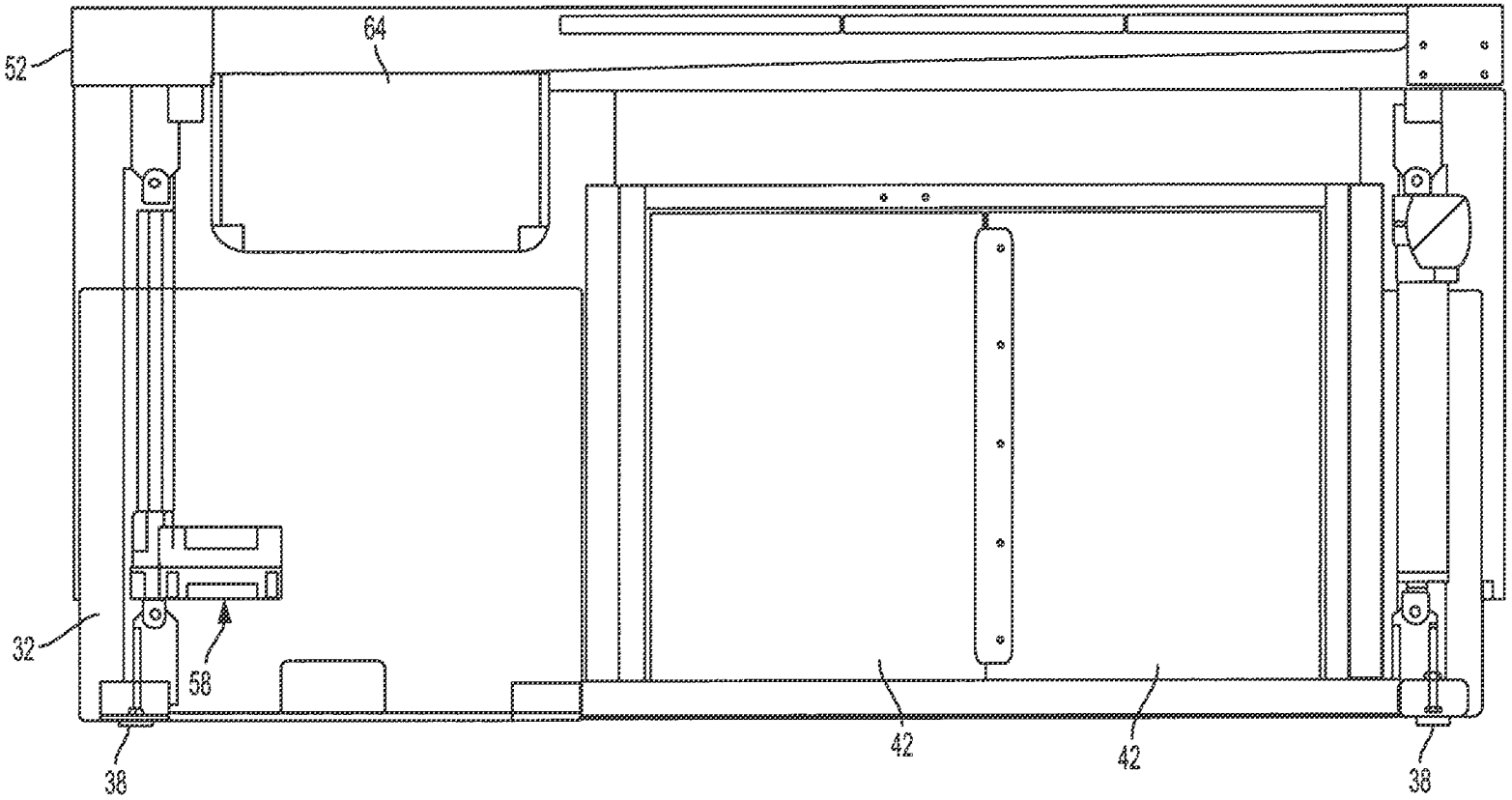
FIG. 5 shows a cross sectional view through line C-C of FIG. 3 of a grossing station according to the present invention.
Figure 6:
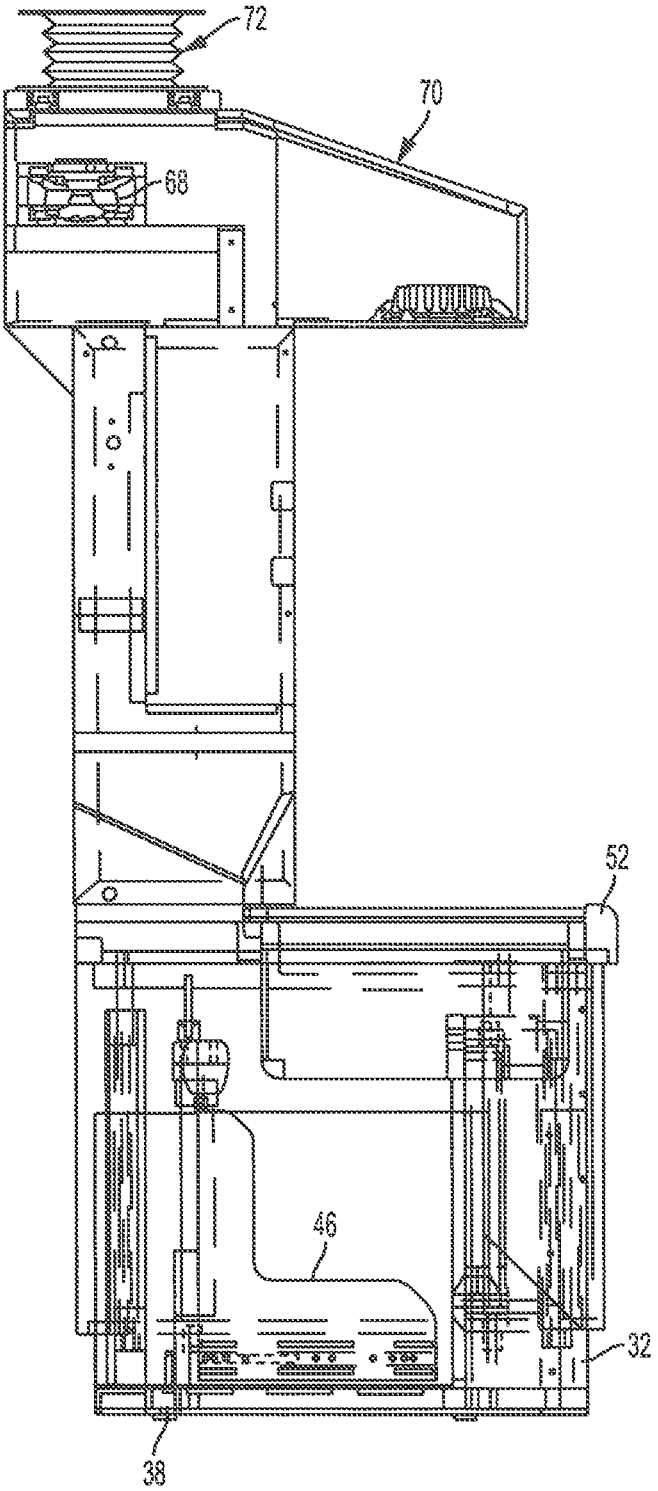
FIG. 6 shows a cross sectional view through line A-A of FIG. 2 of a grossing station according to the present invention.
Figure 7:
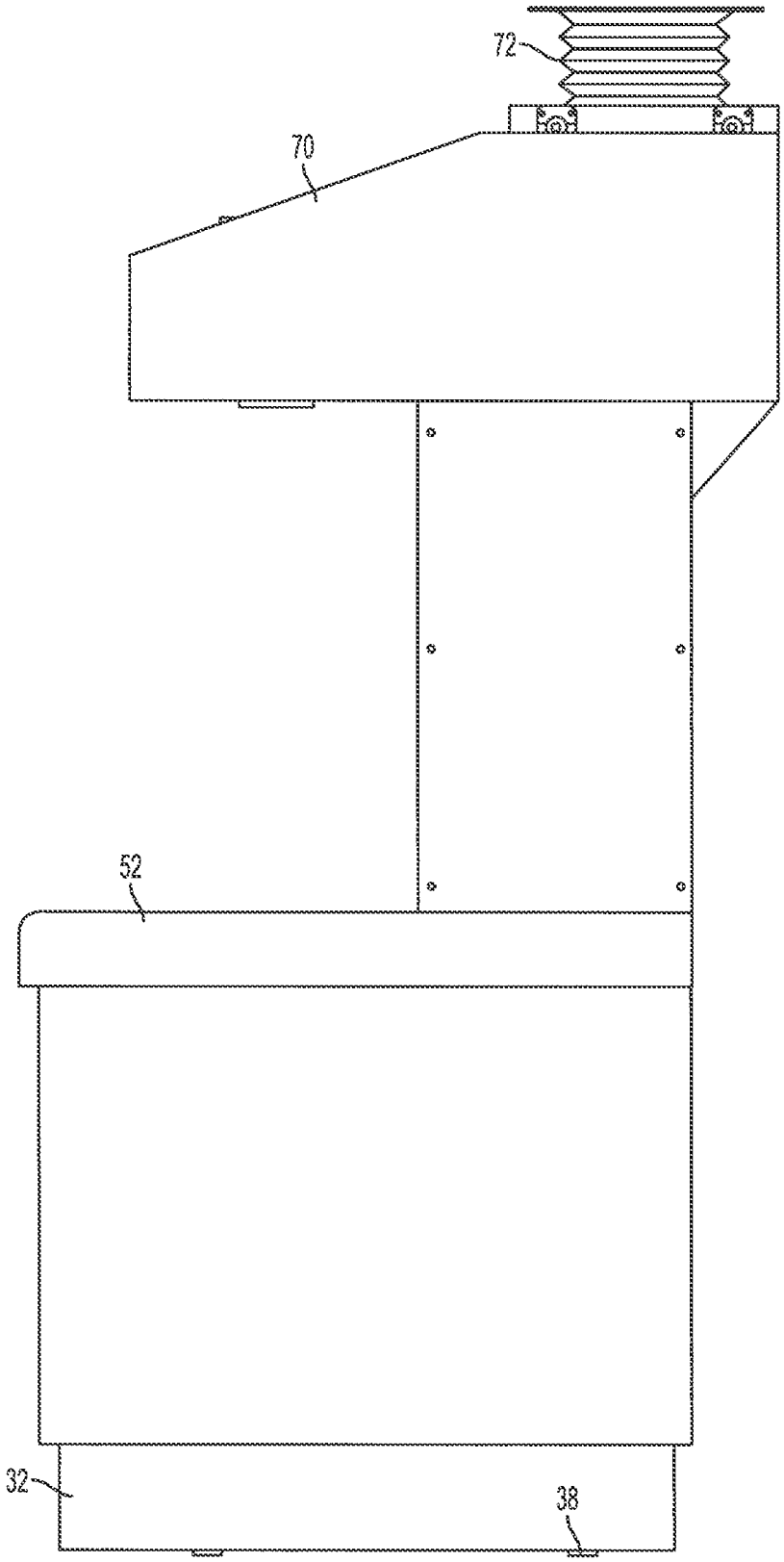
FIG. 7 shows a side view of a grossing station according to the present invention.
Figure 8:
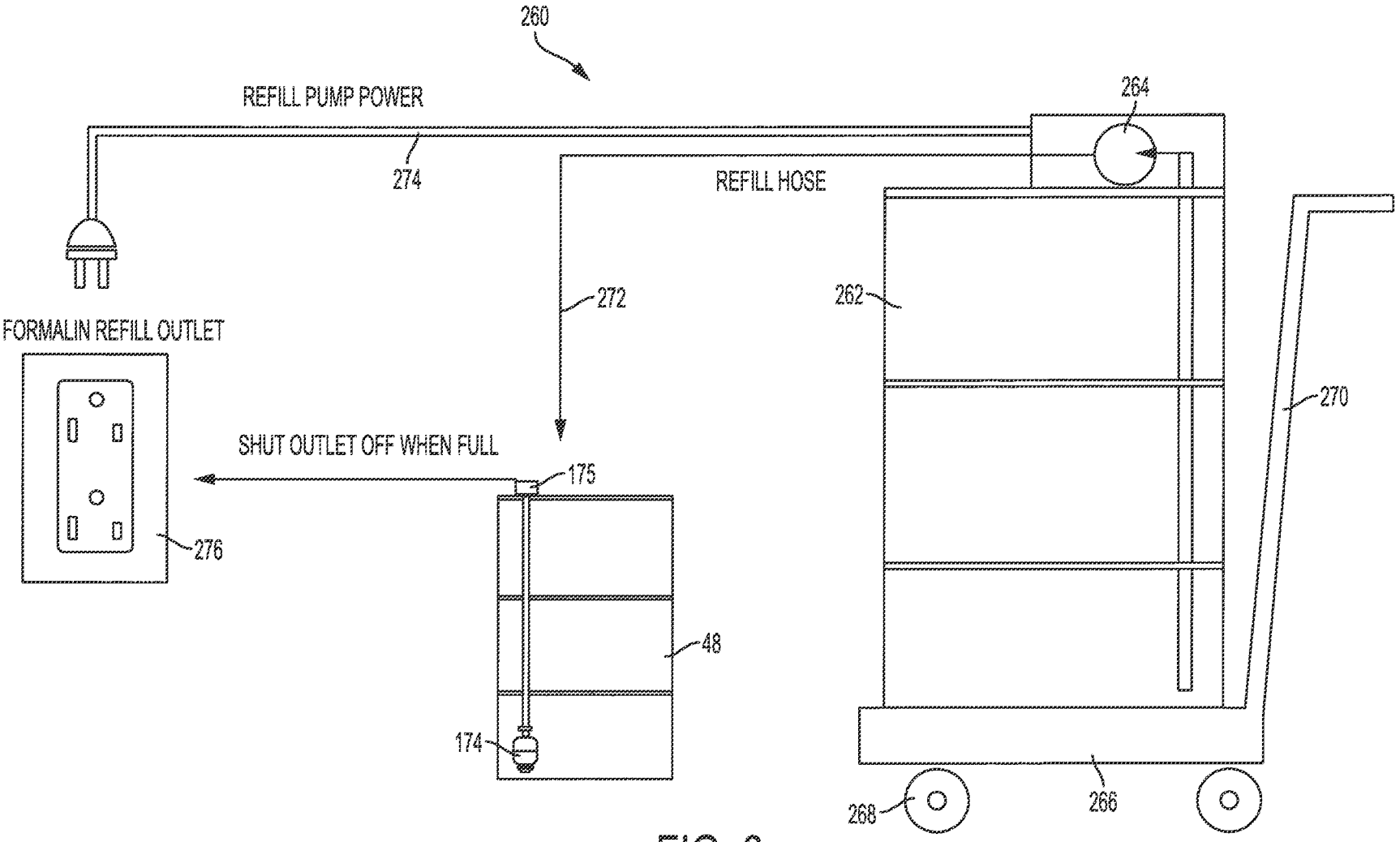
FIG. 8 shows a formalin refill system for use with the grossing station according to the present invention.
Figure 9:
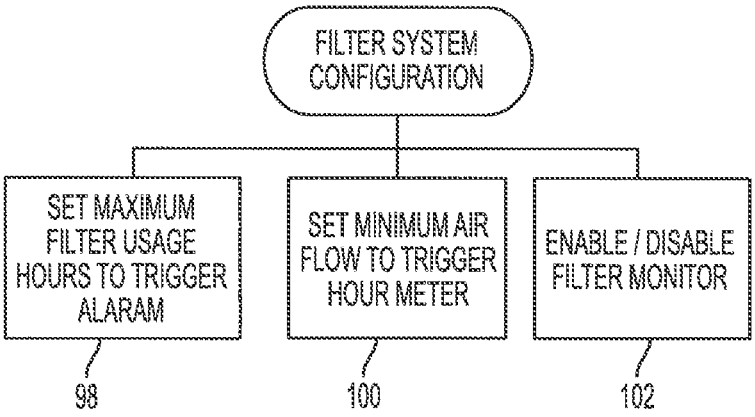
FIG. 9 shows a flow chart for a filter system configuration of a grossing station according to the present invention.
Figure 10:
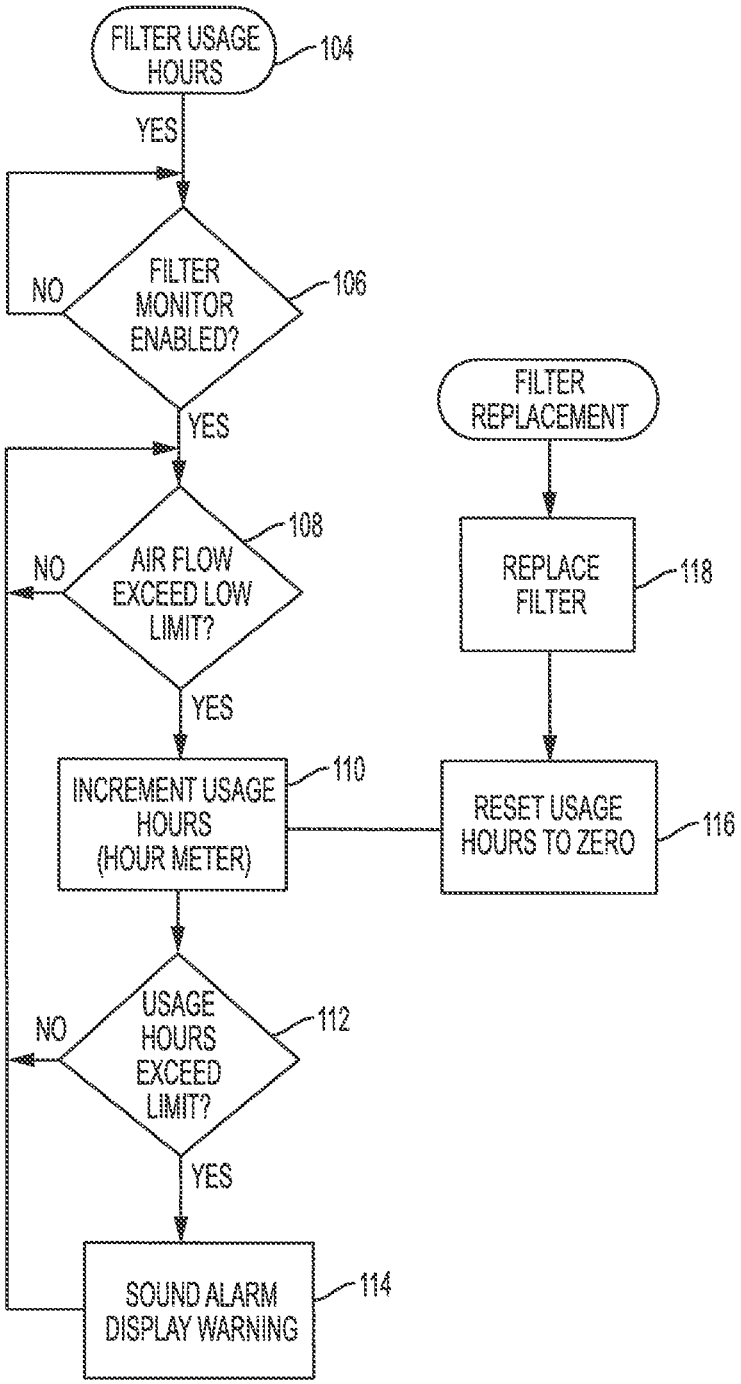
FIG. 10 shows a flow chart for a filter usage system of a grossing station according to the present invention.
Figure 11:
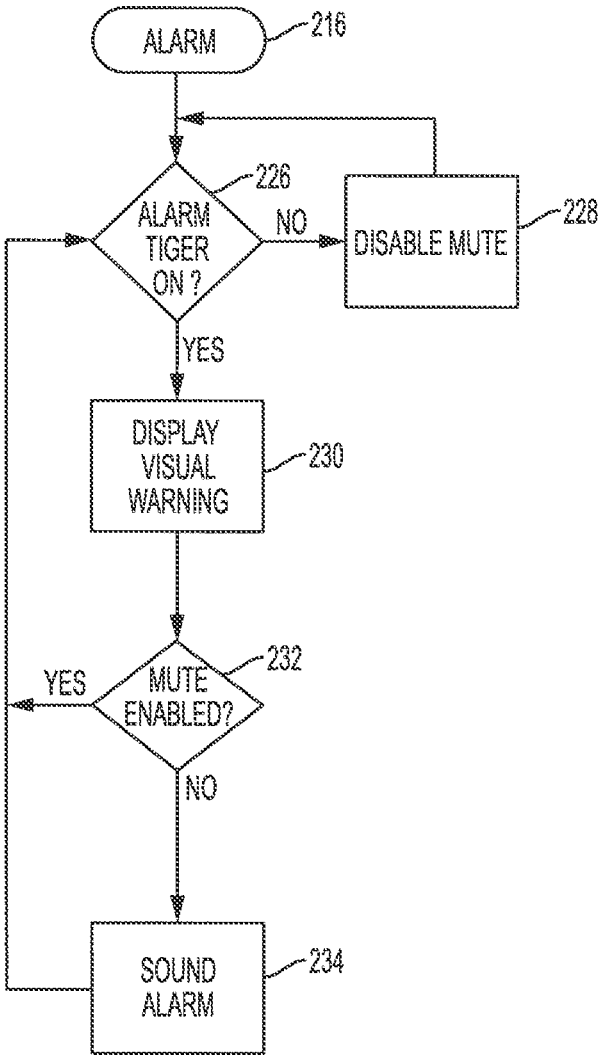
FIG. 11 shows a flow chart for an alarm system of a grossing station according to the present invention.
Figure 12:
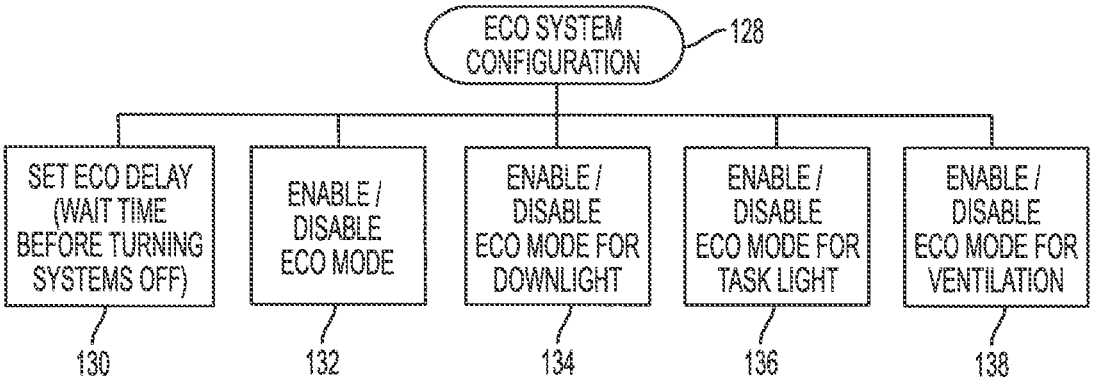
FIG. 12 shows a flow chart for an eco system of a grossing station according to the present invention.
Figure 13:
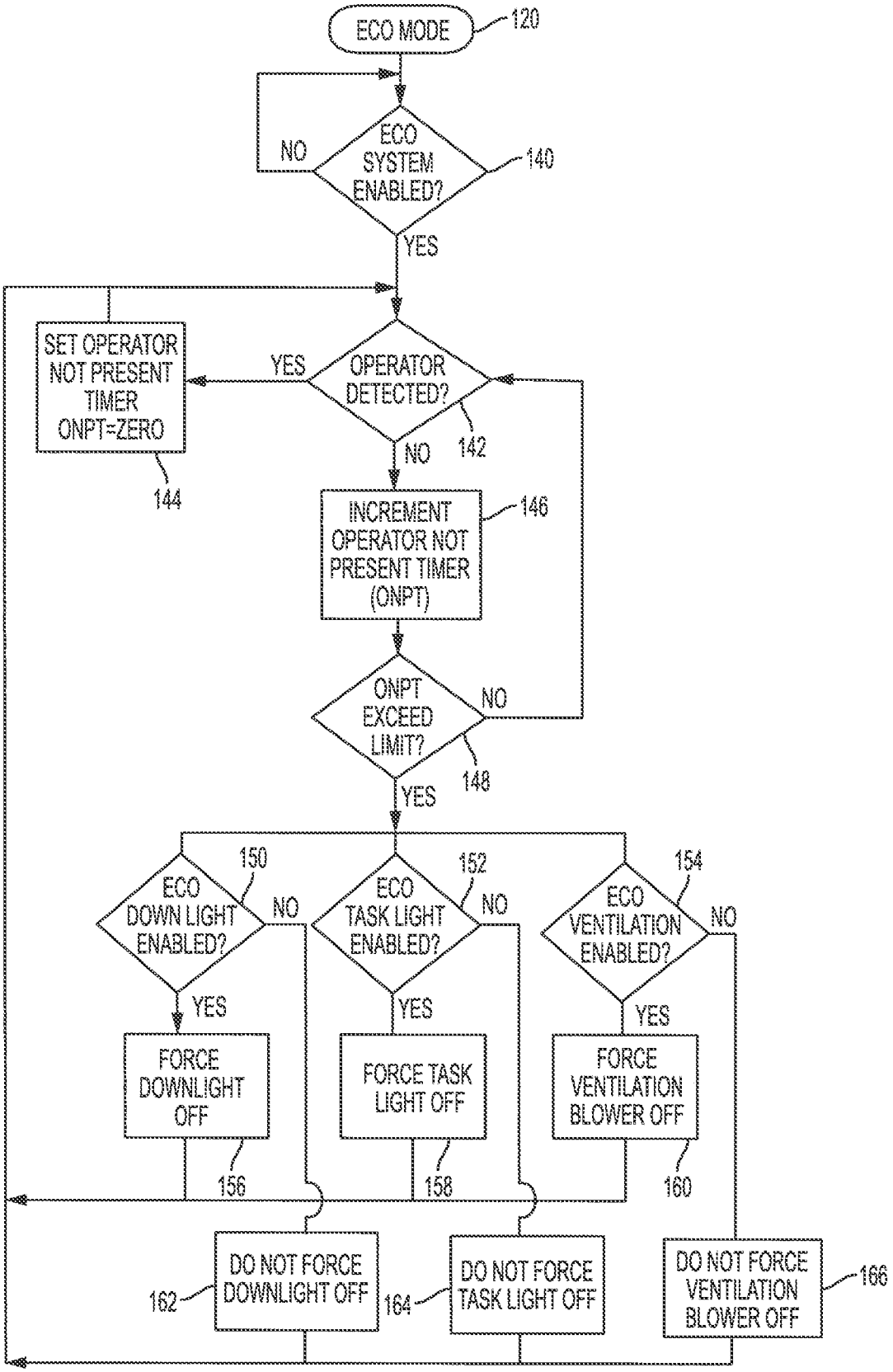
FIG. 13 shows a flow chart for an eco mode of a grossing station according to the present invention.
Figure 14:
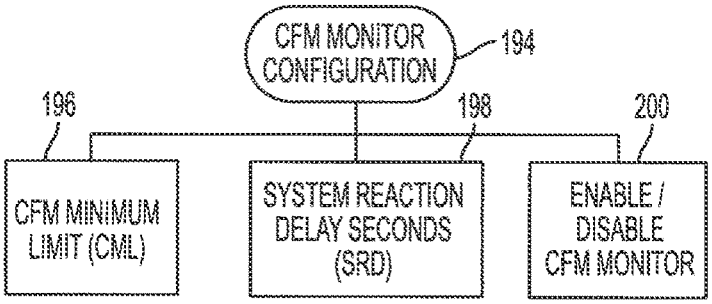
FIG. 14 shows a flow chart for a CFM monitor system of a grossing station according to the present invention.
Figure 15:
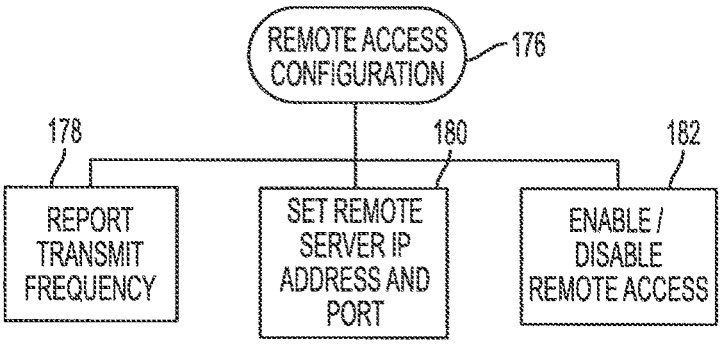
FIG. 15 shows a flow chart for a remote access system of a grossing station according to the present invention.
Figure 16:
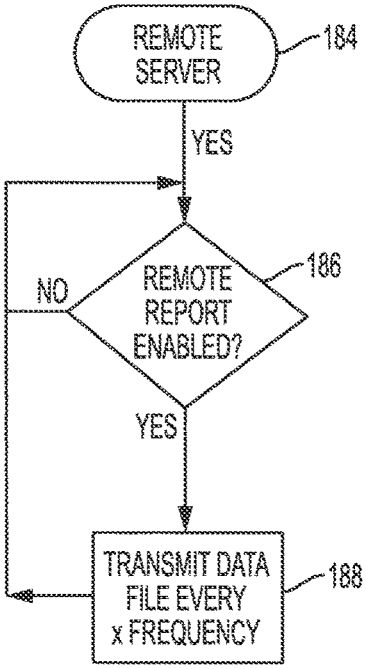
FIG. 16 shows a flow chart for a remote server system of a grossing station according to the present invention.
Figure 17:
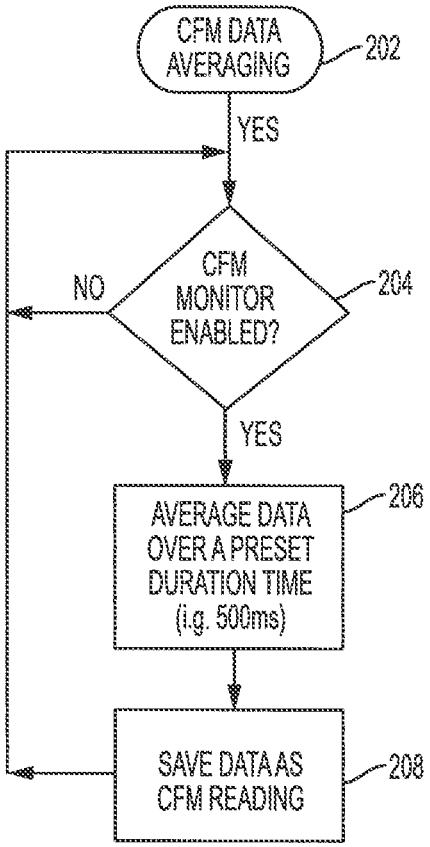
FIG. 17 shows a flow chart for a CFM data system of a grossing station according to the present invention.
Figure 18:
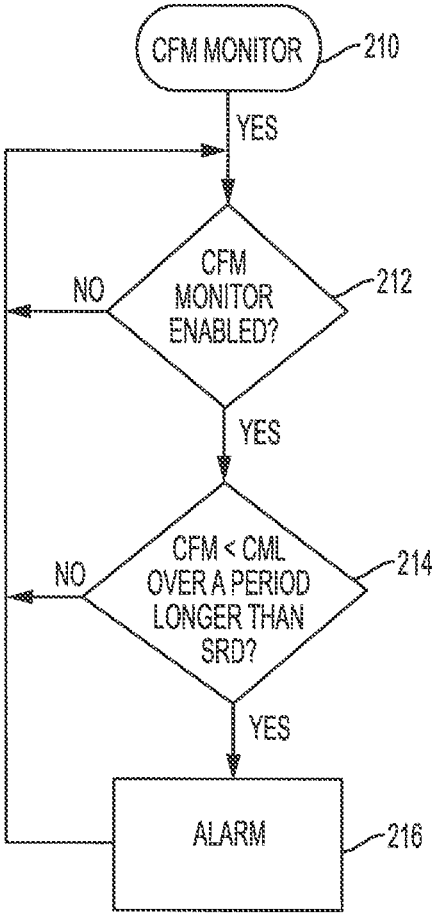
FIG. 18 shows a flow chart for a CFM monitor of a grossing station according to the present invention.
Figure 19:
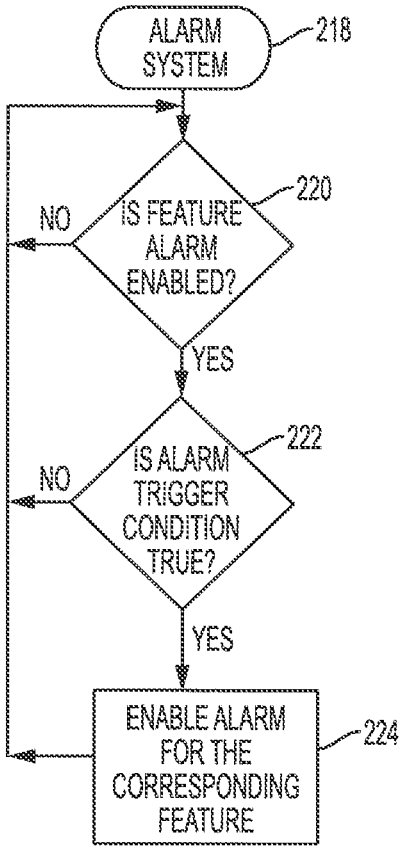
FIG. 19 shows a flow chart of an alarm system of a grossing station according to the present invention.
Figure 20:
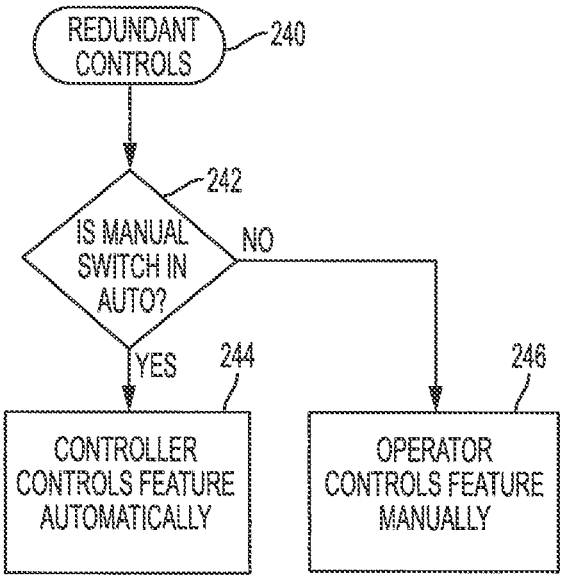
FIG. 20 shows a flow chart for the redundant controls of a grossing station according to the present invention.
Figure 21:
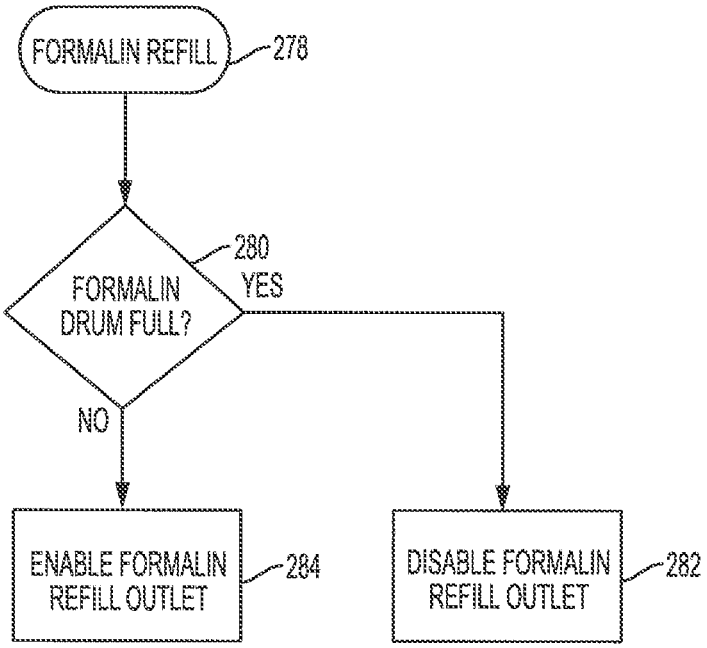
FIG. 21 shows a flow chart for a formalin refill system of a grossing station according to the present invention.
Figure 22:
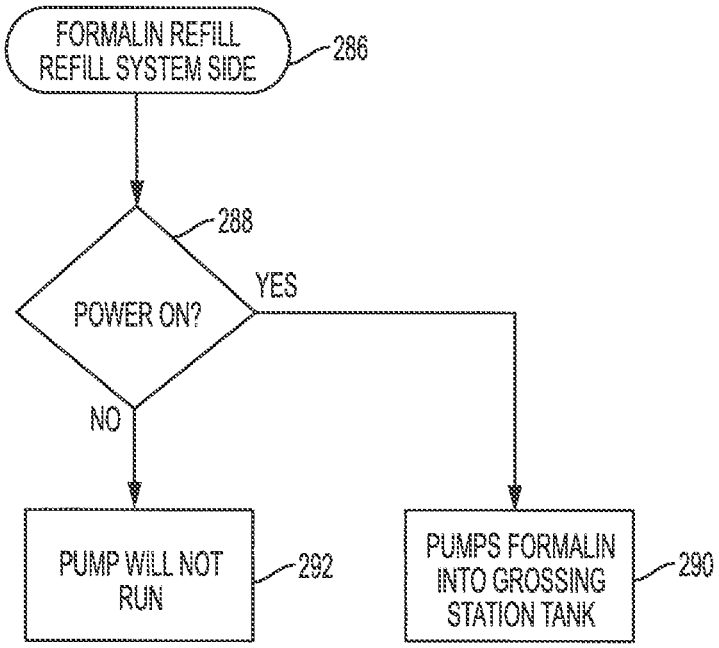
FIG. 22 shows a flow chart for a formalin refill system of a grossing station system according to the present invention.
Figure 23:
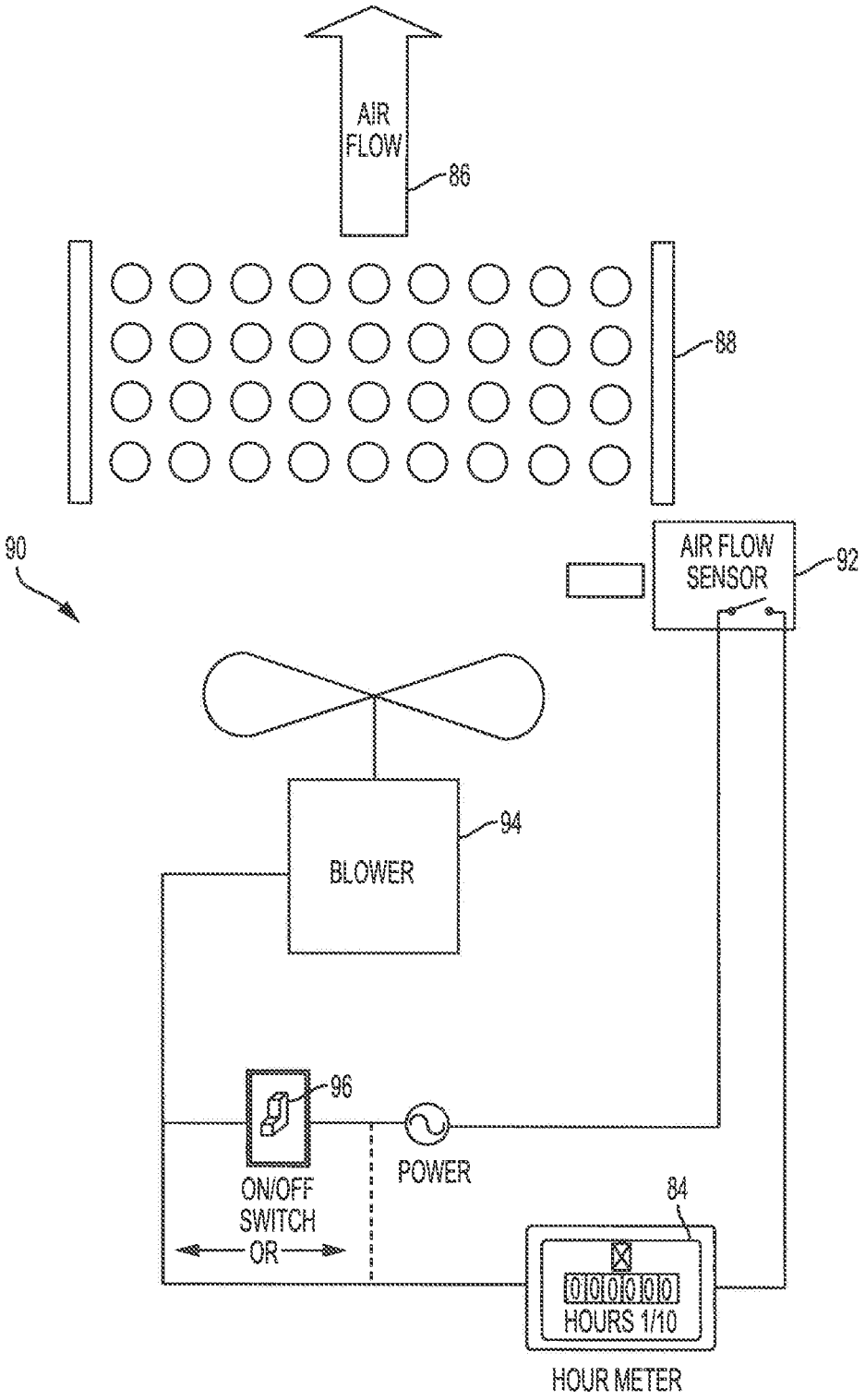
FIG. 23 shows an air flow monitor system for use with a grossing station according to the present invention.
Figure 24:
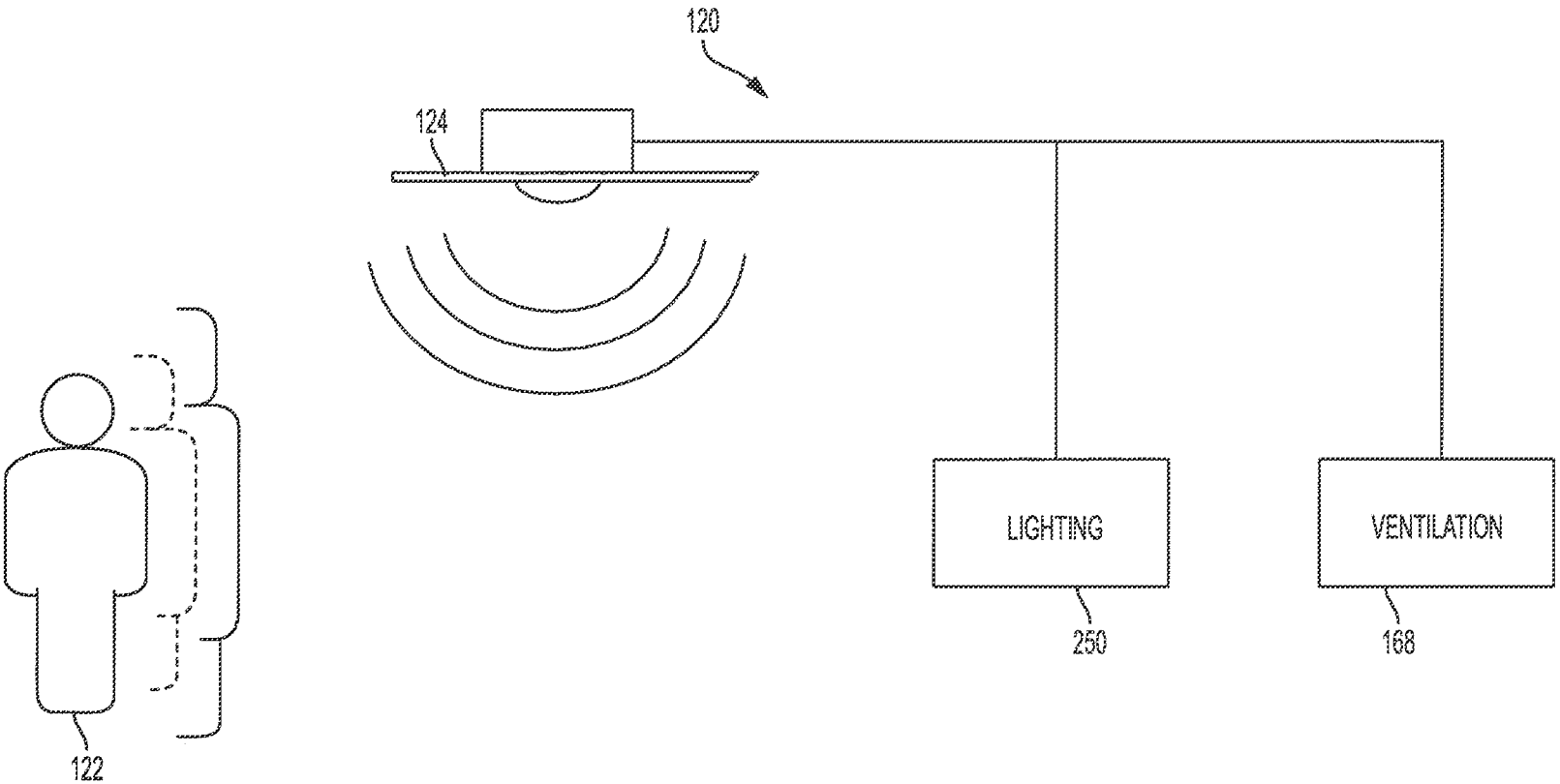
FIG. 24 shows a configuration alarm system for use with a grossing station according to the present invention.
Figure 25:
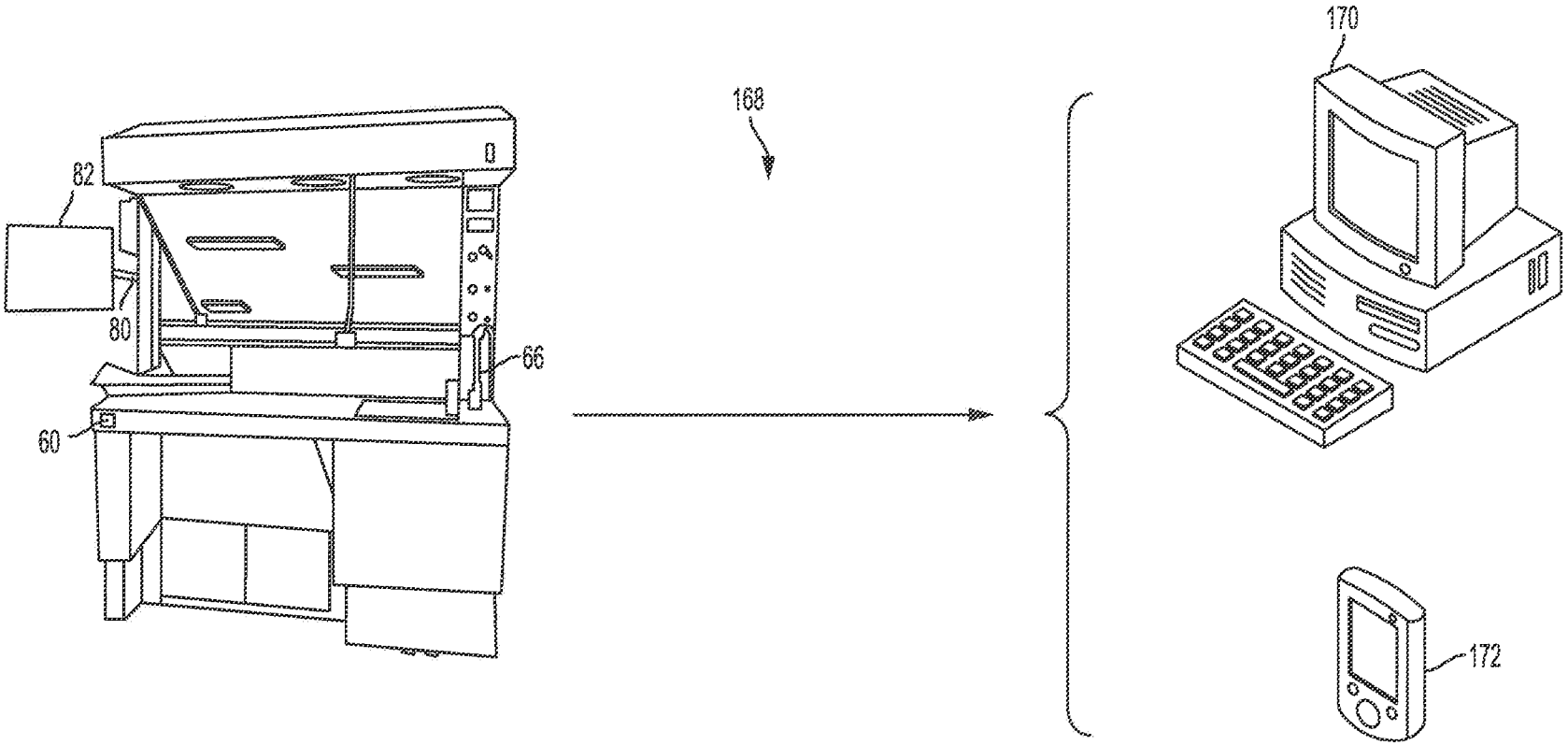
FIG. 25 shows a low formalin warning system for use with a grossing station according to the present invention.
Figure 26:
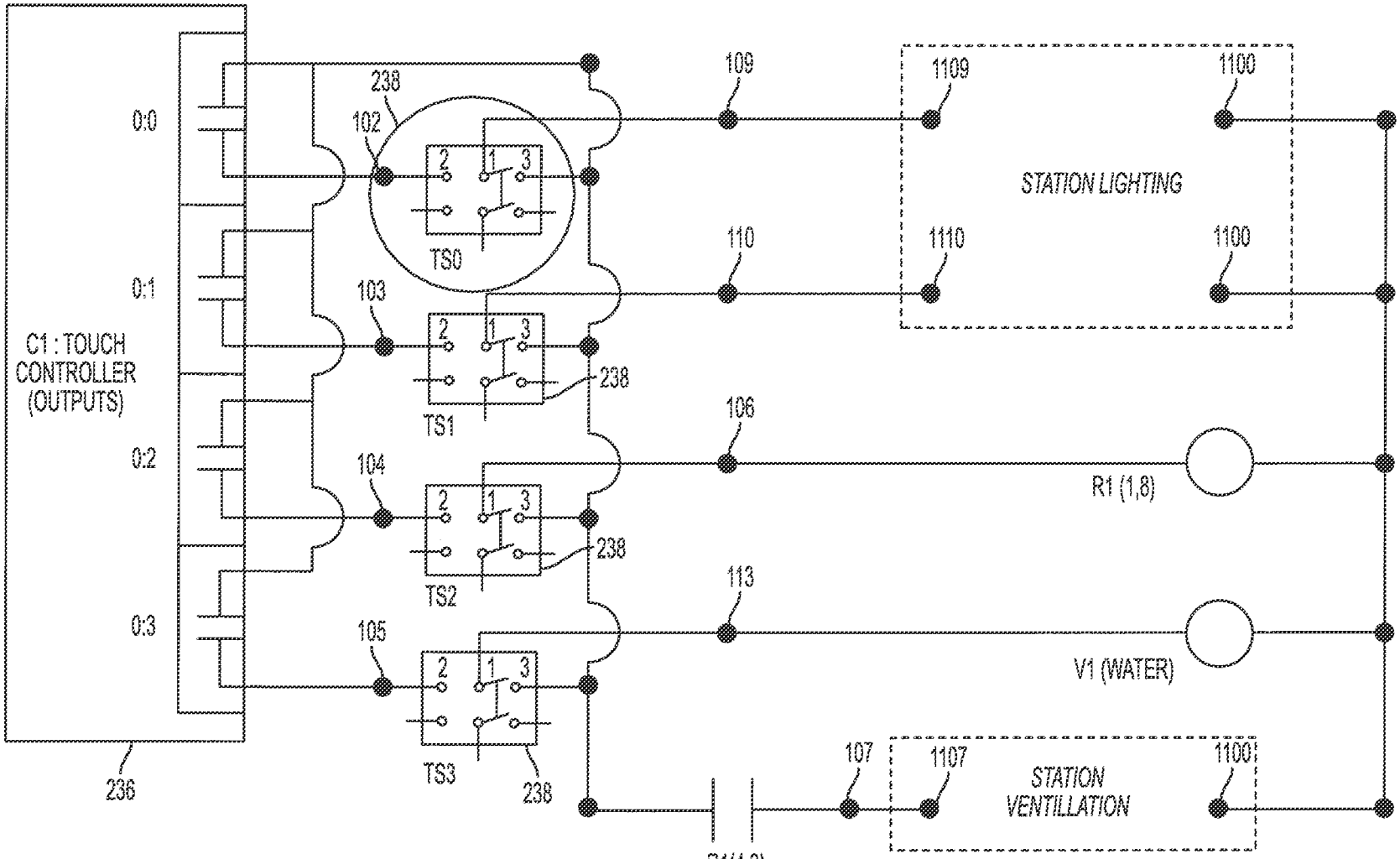
FIG. 26 shows a schematic of a manual override system for use with a grossing station according to the present invention.
Figure 27:
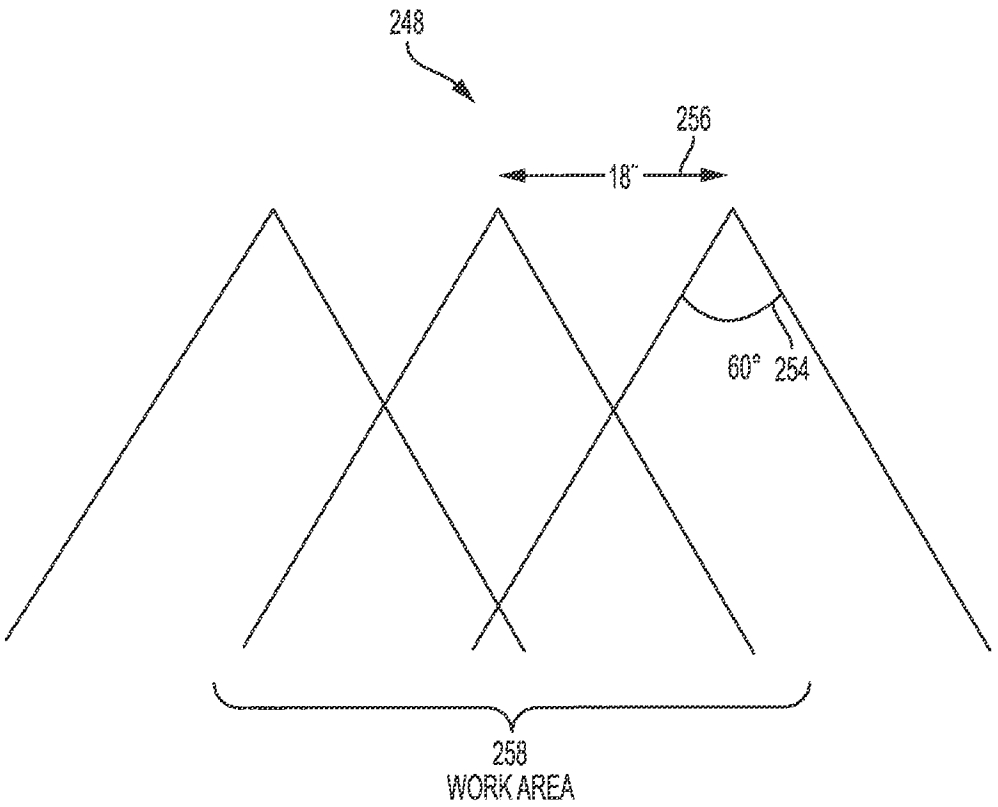
FIG. 27 shows a lighting system for use with a grossing station according to the present invention.
Figure 27:
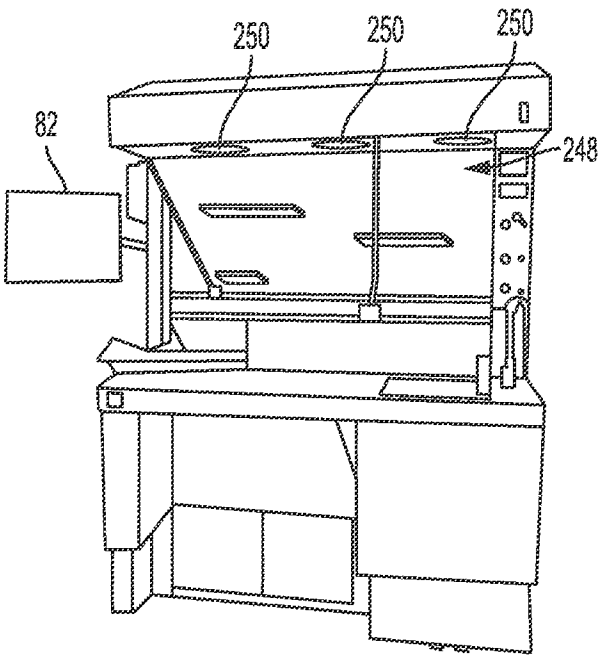
Figure 28:
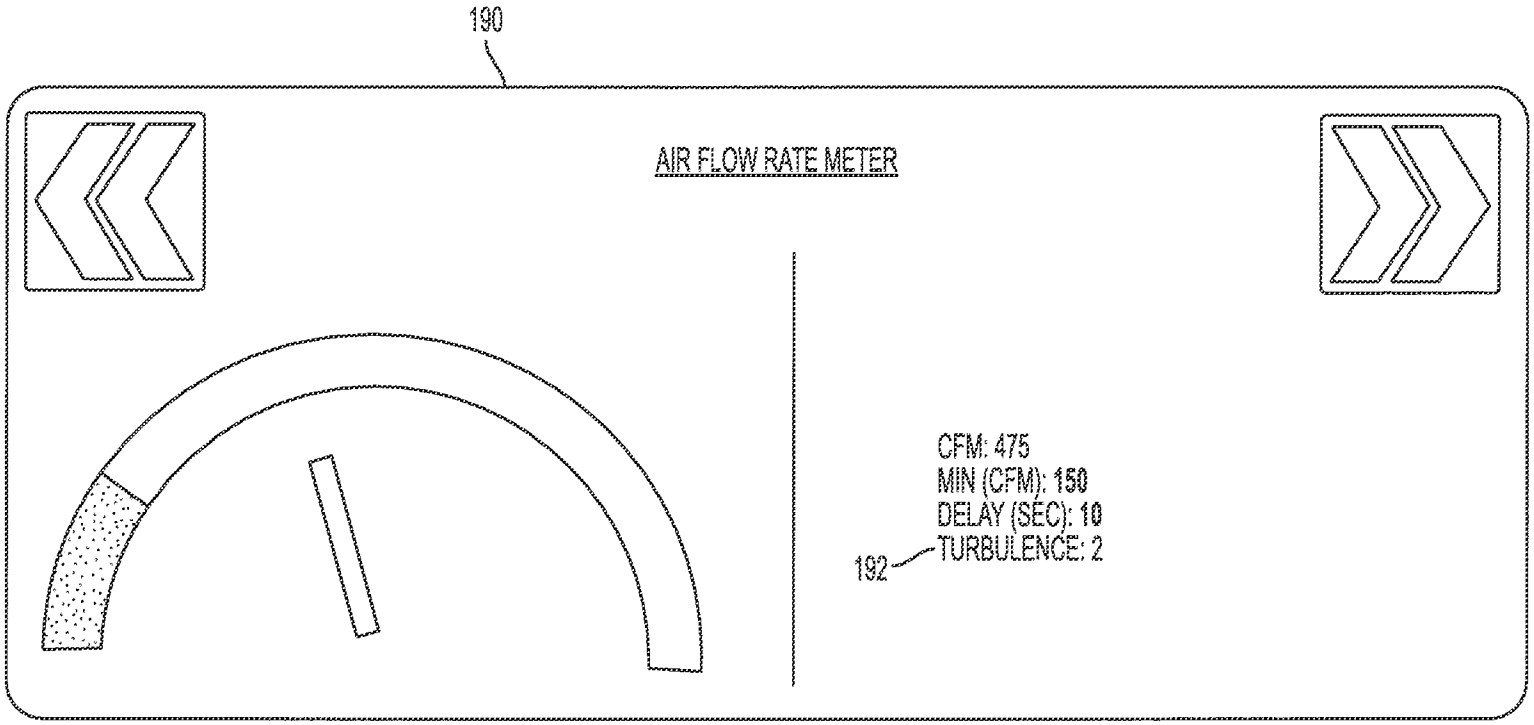
FIG. 28 shows an air flow rate meter for use with a grossing station according to the present invention.
Figure 29:
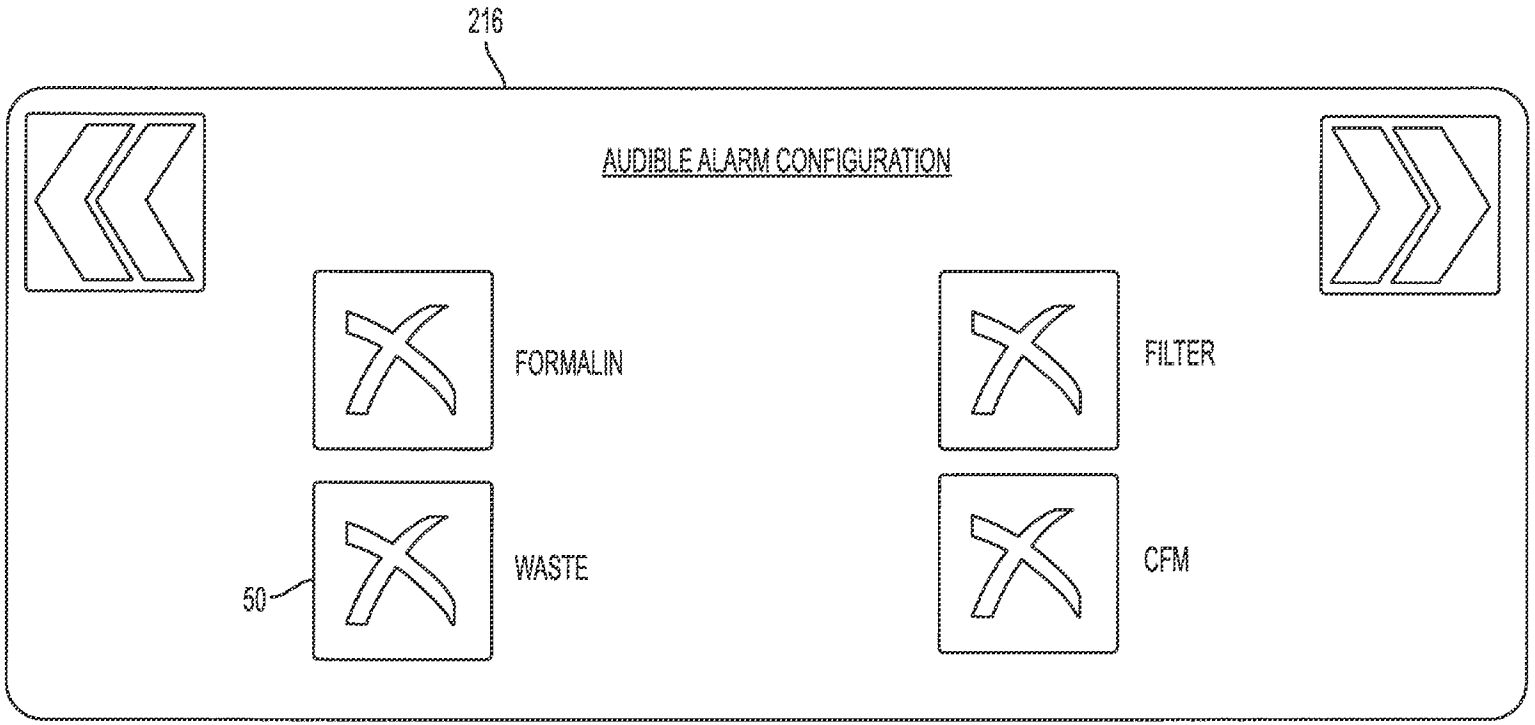
FIG. 29 shows an audible alarm for use with a grossing station according to the present invention.

Referring to the drawings, a grossing station 30 that is capable of being adjusted to various heights is shown according to the present invention. It should be noted that the grossing station 30 may be used on any known autopsy, necropsy, trimming, pathology, or any other procedure performed on tissues or the like all of which are for use in hospitals, morgues, funeral homes, university laboratories, other laboratories and any other structure that can be used for examining human and animal bodies or human and animal body parts.

The grossing station 30 of the present invention includes a base 32, which generally is arranged on a floor or other surface in a lab or room in which the grossing station 30 may be used. It should be noted that it is also contemplated to attach the grossing station base 32 to a wall and elevate it off of the floor or to place it on a frame above the floor. The base 32 generally includes a first 34 and second leg 36 and a cross member 40 arranged therebetween. The base 32 may have any known predetermined height and width. Each of the leas 34,36 generally may have a square or rectangular shape when viewed from the side. The base 32 may have an appropriate pad 38 arranged at a bottom surface of the legs 34,36 which engages with the floor or a surface of the lab in which the grossing station 30 is arranged. The base 32 may include an opening in the cross member 40 thereof which may have a door 42 arranged in the opening. The door 42 in one contemplated embodiment is a sliding door 42, the door 42 arranged as shown in the figures, is a swinging door and/or a sliding door. However, the door 42 may be arranged on both portions thereof to cover the opening in the base 32. It should be noted that any other type of door, such as a swing door, panel door, folding door, or the like may be used in the base 32. It should be noted that a shelf 44 may also be arranged within the opening of the base 32 behind the door 42. The shelf 44 may be made of any known material and may have any known dimensions. The shelf 44, which may be a slidable shelf, generally may have a rectangular bottom surface that may or may not have a perforated panel arranged thereon. A lip 46 may be formed at the front edge of the sliding shelf 44 or along the entire outer periphery of the sliding shelf 44. It should be noted that the sliding shelf 44 may have any other known shape other than rectangular depending on the design requirements of the grossing station 30. In one contemplated embodiment the sliding shelf 44 may also have a full back wall extending from the rear edge of the shelf 44 and either full side walls or partial walls as shown in the Figures. It should be noted that a small edge, may be arranged around the entire shelf 44 or the shelf 44 may have a closable door with high walls completely surrounding the bottom surface of the slidable shelf 44. In one contemplated embodiment the sliding shelf 44 may be used to hold and store formalin or other chemicals used during autopsy, necropsy or pathology procedures. This may allow for the formaldehyde or formalin to be passed through associated tubing from the storage container 48 up to the surface of the grossing station table and then return to a holding or waste container 50 which is located outside of the sliding shelf or on the sliding shelf itself. A plurality of connections may end in faucets, spickets, spray guns, or the like on the grossing station work surface to allow for the autopsy procedure being conducted to access the necessary chemicals for preparing, storing and examining the tissues thereon. It should be noted that the base 32 is generally made of a metal material, however any other ceramic, composite, natural material, plastic or the like may be used for the base 32 and the shelf 44 arranged therein. Furthermore, the panels used on the door 42 of the base 32 generally have a glass material arranged therein to allow for viewing of the contents of the shelf 44. However, any other known plastic, ceramic, composite, natural material, metal or the like may also be used for the door or doors 42 arranged on the base 32 in front of the shelf 44.

The grossing station 30 may also include a table or work surface area 52 arranged over a top portion of the base 32. The table 52 may have a generally rectangular and flat work surface arranged on the top end thereof and a first 54 and second leg 56 arranged on the sides thereof. The first and second legs 54,56 are arranged over the first 34 and second legs 36 of the base 32. A lifting mechanism 58 may be arranged between the base 3 and the table 52 of the grossing station 30. This may allow for the table 52 to be adjusted to any number of predetermined heights to accommodate different size users conducting the pathology procedures on the grossing station 30. Generally, the legs 54,56 of the table 52 may have a rectangular shape when viewed from the side. However, any other shaped leg may be used for the legs of the table 52. The table 52 may also have a cross member arranged between the first and second legs 54,56 of the table 52 and arranged over and may slide over the cross member of the base 32. It should be noted that any type of lifting mechanism 58 may be used on the grossing station 30 of the present invention, such as hut not limited to a linear actuator, scissor actuator, screw actuator or any other lifting device, electronic, fluid driven, gas driven, air driven, electrical or mechanical driven, may be used to move the table 52 with relation to the base 32 to adjust the grossing station work surface to a predetermined height. The table 52 also may include a trough arranged in a top surface thereof. The grossing station 30 also may include a switch 60 arranged on a front surface of one of the legs or other surface of the grossing station table that may allow for the upward and downward movement of the work surface of the table 52 with relation to the base 32 and floor or surface on which the grossing station 30 is arranged. It should be noted that the associated electronics are in electrical communication with the switch 60 and the lifting mechanism 58 and to the power grid into which the grossing station 30 is connected. Other switches also may be arranged on the table at a predetermined position or any other surface of the grossing station 30 to operate the blower and ventilation system, lights, computers, etc., for the grossing station 30.

The table 52 of the grossing station 30 may include a plurality of removable and interchangeable grid plates 62 which may be arranged and fit securely into the trough of the table 52. The grid plates 62 generally are rectangular or square however any other shape grid plate 62 may be used depending on the design of the grossing station table 52. The grid plates 62 may be of any known design, but generally include at least a solid plate design, a perforated plate design, and a sink. This may allow the user of the grossing station 30 to customize the work surface for the grossing station 30 per their requirements. It is contemplated to use the grid plates 62 in any combination of perforated grid plates, solid plates and sinks, a combination of sinks and perforated plates, a combination of sinks and solid plates, a combination of all sinks, a combination of all perforated plates and one sink 64, etc. Any known configuration may be used with the interchangeable grid plates 62. Generally, the interchangeable grid plates 62 may have a rounded front edge to help create an ergonomic edge for use by the user of the grossing station 30. The grid plates 62 may interact with a first and second shoulder arranged near a top surface of the grossing station table 52 at the trough edges. The sink 64, which may be used as one of the grid plates, may have a drain hole that interacts with the trough and/or a drain that is connected to the trough which then drains to the sewage system or other storage area of the building into which the grossing station 30 is arranged. These connections are made by any known piping used in the plumbing industry. It should be noted that the grossing station 30 may be set up in either a right handed sink setup or a left handed sink setup depending on the dominant hand of the user of the grossing station 30. Generally, connected to the top surface on either one or both sides of the table may be a water faucet 66 which may allow for water to be used on either side of the grossing station 30 and to be drained into either a left handed or right handed sink. It should be noted that in one contemplated embodiment a faucet 66 may be arranged on both sides of the grossing station 30 top surface of the table or it may be just arranged on one side depending on the design requirements and configuration of the grossing station 30.

The table 52 also may include a blower and ventilation system 68 which may move air across the entire table 52 including any sinks arranged within the top surface of the table 52 in any known direction, such as a forward to rear direction, bottom to top direction, etc. The blower and ventilation system 68 includes a ventilation duct which is arranged and secured over a front edge of the top surface of the table 52. The table 52 also may include a waste compartment member 50 arranged either on a right or left side on an underside of the table 52. The waste compartment member 50 generally may be used to hold medical waste resulting from the autopsy, necropsy, or pathology procedure being conducted. Any known fastening techniques such as L-brackets may be used to secure the waste compartment 50 in either a right hand or left hand position with relation to the table 52 on an underside surface of the table. The waste compartment then may be capable of storing medical waste or having it removed via a door in either the front or side surface of the waste compartment. It should be noted that arranged in the surface of the cross member may be a waste compartment vent orifice that may allow for venting of any odors from the waste compartment into a storage area, a filter or the outer atmosphere. A cover plate may cover the vent orifice on the side in which the waste compartment member is not arranged.

The grossing station 30 also may include a hood 70 that is secured to a top surface of the table 52 of the grossing station 30. The hood 70 generally may have two side walls and/or partial sidewalls, a rear wall and a top member. The top member when viewed from above generally has a rectangular shape. The hood 70 may also include a flexible bellow duct 72, an access panel 74, a filler retention bracket 76, and back draft grill 78. It should be noted that any necessary lighting and associated electronics to control the lighting may be arranged on surfaces of the hood 70 or on the walls of the hood 70. The rear wall of the hood 70 also may have a plurality of shelves arranged thereon for holding supplies, tools, computer equipment, etc., or the like necessary for the pathology procedure being performed on the grossing station 30. It is also contemplated to have a hanging bracket 80 to connect a computer and computer monitor 82 arranged either at a left, right or center portion of the hood 70 generally extending from an inner surface of the hood. It is also contemplated to have the computer station 82 arranged on a sliding track that extends the entire length of the hood 70 and allows for the user to move the computer station along the entire length to different positions with relation to the grossing station 30. The hood 70 is generally made of a stainless steel material as are all of the other parts, but may be made of any other metal, plastic, ceramic, composite, or natural material depending on the design requirements and the environment in which the grossing station 30 may be used. It should also be noted that the grossing station hood 70 may include a first and second glass panel arranged at each side thereof. The glass panels may be slidable with relation to the sides of the hood 70. The glass panels may be able to slide into a fully open position that generally aligns with or near the front edge of the table 52 of the grossing station 30. The sliding glass panels also may be recessed back into the side walls of the hood 70 for storage when not needed. In one contemplated embodiment the sliding panels may be made of a glass material, however any other ceramic, composite, natural material, plastic, metal or the like may be used for the sliding panels. In effect, extending the glass panels into the fully open position, which is at or near the front edge of the top surface of the table 52 of the grossing station 30, it may create a fume hood which may be certified to remove all fumes during the autopsy, necropsy or pathology procedure thus meeting more stringent standards required in some laboratories and hospital environments. However, the panels may also be recessed into a stored position during other autopsy, necropsy or pathology procedures depending on the part being examined during the procedure and the possibility of noxious fumes, gasses or the like being present that would require the use for a fully extended fume hood setup. Any known sliding mechanism or hinge may be used to slide and control movement of the sliding panels into and out of the side walls of the hood 70. It should be noted that any known roller, hinge, or the like may be used to move the glass panels with relation to the side walls of the hood 70.

In operation, it should be noted that all of the necessary piping, plumbing, and electrical connections are secured either to a surface of the hood 70 of the grossing station 30, the table 52 or base 32 of the grossing station 30 and are connected to the building systems in which the grossing station 30 is arranged. Copper tubing, rubber tubing, any necessary electronic circuitry, switches, and any known pumps may be used to move the table 52 with relation to the base 32 and to move the air via the blower and ventilation system 68 into either the outside atmosphere, a storage area or into a filter mechanism. Any known fasteners and holders, such as clips, rods, bands, etc., may be used to secure the piping and electrical components to the surfaces of either the table, base or hood of the grossing station 30 according to the present invention. The grossing station 30 having an integrated system for delivering chemicals and other components, such as gas or liquids to the table, may have the necessary piping, tubing, in either a closed or open loop system to operate with such chemicals in a closed environment of a building or lab. The necessary faucets and dispensers will all be arranged either on the table 52 or a surface of the hood 70 in order to provide an ergonomic work station such that dispensing of chemicals or other liquids or materials necessary for the pathology procedure are in easy reach of the lab or person conducting such procedures. In operation, the user may be able to adjust the height of the table top work surface of the grossing station 30 to fit his or her height. Thus, any user of the grossing station 30, either tail or short, may adjust the work surface for more ergonomic satisfaction with relation to their height. Furthermore, the operation of the lifting mechanism 58 may be controlled by a single touch switch in an upward or downward motion with relation to the floor in which the grossing station 30 is arranged. Furthermore, the operation of the blower system 68 may allow for complete evacuation of all odors or noxious fumes from the work surface area which would keep fumes from emanating in an upward direction toward the user. This may ensure a more clean, efficient, and safe work environment for the user of the grossing station 30. Furthermore, the interchangeability of the grid plates 62 and the waste compartment member 50 to be left handed or right handed, will provide a grossing station 30 that is more ergonomically and easy to use for the user performing the pathology procedures thereon. The grossing station 30 also may have an electronic control and monitoring system which allows for seamless control and monitoring of all components, systems, subsystems, devices, functions and/or modules of the grossing station 30 and related systems.

As shown in the attached Figures, the grossing station 30 of the present invention also may improve the users experience by including a filter hour meter 84 thereon. Generally, in the prior art, grossing station and dissecting table filters were often put on a time period based replacement schedule. In some cases, an hour meter was used to record the usage time instead of the time period. These prior art hour meters are typically connected to the same circuit that turns the ventilations system on and off, hence when the ventilation system is turned on the hour meter starts recording usage time. In the prior art systems, if the ventilation blower was turned on, but there was an obstruction in the ventilation duct, such as a closed damper or possibly an object blocking the intake grill of the grossing station or another type of condition causing the flow to be blocked, the hour meter would still continue to record the time even when the flow is blocked and the filter is not being used. This type of situation could also be true if the blower motor or the blower itself was defective, such as a broken belt, defective motor, motor overload, shutoff, wherein these conditions would cause the usage timer to record time when there is no air flow going through the filter, thus causing the filters to be replaced prematurely. The filter hour meter 84 of the present invention has implemented and includes a configurable air flow based trigger hour meter 84. Hence, with the air flow filter hour meter system of the present invention, the time is only recorded when the air flow 86 is above a minimum limit that is set by the user. This may allow for a small but significant improvement compared to the typical ventilation on time based trigger method. The filter hour meter system 90 of the present invention may only record time when there is air flow 86 causing the filter 88 to actually perform its function. The air flow 86 based filtering system for the air filter 88 used in the air flow system of the grossing station 30 of the present invention can very quickly pay for itself by reducing the number of unnecessary filter 88 changes by ensuring that the filter 88 only is replaced when it is dirty and when it needs to be. According to the Figures, an hour meter 84 is in communication with an air flow sensor 92, which is arranged near the air filter 88 of the grossing station 30 according to the present invention. The air flow sensor 92 is arranged between the blower 94 and the filter 88 of the air flow system 90 and hence, monitors when air is actually entering the filter 88, thus increasing the hours meter 84 only when the air filter 88 was actually used. When the switch 96, which controls the air flow system 90, is powered off the air flow hour meter 84 will not increase/increment and it will only increase when actual air flow 86 hits the air flow sensor 92, which is arranged directly adjacent to or before the filter 88 or in the ducting of the air flow system 90 of the grossing station 30. The user of the grossing station 30 may be able to preset within the methodology of the filter system configuration the maximum filter usage hours 98, which are needed to trigger an alarm. They may also set a minimum air flow rate 100 needed to trigger the hour meter 84 and be able to enable and disable the filter monitor 102. The filter usage system 90 may include a methodology that may initially determine what the filter usage hours currently are in block 104 and then enter block 106 and determine if the filter monitor is enable. If the filter monitor is not enabled, the methodology will return to block 106. If the filter monitor is enabled, the methodology may next enter block 108 to determine if the air flow has exceeded the preset low flow limit. If the air flow 86 has exceeded the preset low limit, the methodology enters block 110 and increments the usage hours on the hour meter 84. If the air flow 86 has not exceeded the low limit, the methodology returns to block 108. After incrementing the usage hour meters in block 110 the methodology may enter block 112 and determine if the usage hours exceed the preset limit. If the usage hours have exceeded the preset limit for the filter 88, the methodology may enter block 114 and sound an alarm and display a warning that the filter 88 must be replaced. If the usage hours have not exceeded the limit, the methodology may return to block 108. After the filter alarm has sounded, a filter 88 replacement may occur in block 118 by the user of the grossing station 30 and after replacement of the filter 88, the filter usage meter 84 may be reset to zero hours in block 116 and the methodology may start again in the filter usage hours block 104

The grossing station 30 of the present invention may also include an eco mode system 120. This eco mode system 120 may detect the presence of individuals 122 in proximity of the grossing station 30. The eco mode system 120 may allow the grossing station 30 to use a motion detection sensor 124 that can be user configured to perform numerous functions. In one contemplated embodiment, the motion detection sensor 124 may be programmed such that the lights 250 of the grossing station 30 may be turned off when the station is left unused for more than a predetermined set time. The methodology may also turn the ventilation system of the grossing station 30 off if the station is left unused for more than a preset time limit. It should be noted that these systems are then turned on when the user is back, either automatically via detection by the motion detection sensor 124 or manually by the user. It should also be noted that this feature, not only saves energy, but it also extends the filter life, the LED lights life, and the blower motor life by only using such features when a user is performing an autopsy, necropsy, or pathology procedure at the grossing station 30. It should be noted that the motion detection sensor 124 may be any know motion detection sensor 124 known in the art and that it generally is attached and secured to a portion of the hood 70 of the grossing station 30. However, it should be noted that the motion detection sensor 124 may be connected to either of the table 52 or base 32 of the grossing station 30 along with any of the walls of hood 70 of the grossing station 30 depending on the design requirements and environment in which the grossing station 30 may be used. It should be noted that the motion sensor 124 may be wired directly to the electronic control and monitoring system controller of the grossing station 30 or may be wirelessly in communication with the controller system of the grossing station 30 according to the present invention. It should be noted that any known fasteners may be used to connect the motion detector 124 in the proper position and at the proper setting within the grossing station environment. In the methodology, which controls the eco mode system of the grossing station 30 according to the present invention, the configuration 128 may allow for the user to set the eco delay at a predetermined time 130, which will set the wait time before turning the systems off. The eco system also may allow for the user to enable or disable the eco mode 132 and enable or disable the eco mode for both the down light 134, the task light 136, and for the ventilation system 138 of the grossing station 30 according to the present invention. The eco system 120 may be configurable to the user's necessary requirements. Furthermore, in the methodology which controls the eco mode system 120, the eco mode system may enter block 140 and determine if the eco system is enable. If the eco mode is not enabled, it may return to block 140. If the eco system is enable, it may enter block 142 and determine if an operator/user is detected at the grossing station 30. If an operator is detected, it may enter block 144 and set the operator not present timer (ONPT) variable equal to zero. This will keep the lights 250 and ventilation systems of the grossing station 30 on. The methodology may then return to block 142. If in block 142 the methodology detects that no operator of the grossing station 30 is there, it enters block 146 and increments the operator not present timer (ONPT) and then enters block 148 and determines if the ONPT has exceeded the preset time limit. If it has not exceeded the preset time limit, the methodology returns to block 142. If the ONPT has exceeded its preset limit, the methodology may enter block 150 and determine if the eco down light is enabled, enter block 152 and determine if the eco task light is enabled, enter block 154 and determine if the eco ventilation is enabled. If the eco down light is not enabled, the methodology may enter block 162 and keep the lights off or not force the down light off and then return to block 142. If the coo down light is enabled, the methodology may enter block 156 and force the down light to be turned off and then return to block 142 of the methodology. If the eco task light is not enabled, the methodology may enter block 164 and keep the light off or not force the task light off and then return to block 142. If the coo task light is enabled, the methodology may enter block 158 and force the task light to be turned off and then return to block 142 of the methodology. If the eco ventilation is not enabled, the methodology may enter block 166 and keep the ventilation off or not force the ventilation blower to be turned off and then return to block 142 of the methodology. If the eco ventilation is determined to be enabled and turned on, the methodology may enter block 160 and force the ventilation blower system off by turning off power thereto and then return to block 142 of the methodology. It should be noted that the Eco delay time may be set anywhere between one second and eight hours.

The grossing station 30 of the present invention also may have a remote warning system 168 that may monitor the formalin tank 48 and display a warning indicator on the grossing station 30 when the tank is empty. It may also monitor the waste tank 50 and warn the user when the tank is full. These warnings, along with the filter change requirement warnings, may also be sent to a remote server 170 to request a formalin refill or waste disposal. The system 168 may make an efficient way to deploy the preventive maintenance crew only when needed, such as when the waste disposal container is full or a formalin refill is needed. The waste tank 50 and the formalin tank 48 are arranged as described above within the grossing station 30. Any type of hand held device 172 or laptop computer, server, or desktop may be used to receive the notices from the remote warning system 168 of the grossing station 30. It should be noted that the remote warning system 168 may be hard wired to the external computers or handhelds or may be wirelessly transmitted via wifi network, blue tooth, cellular or the like. The necessary sensors may be arranged on the formalin tank 48 and the waste disposal tank 50 and either wirelessly transmitted to the system controller for the grossing station 30 according to the present invention. The sensors 174 are arranged either directly on the outer surface of the formalin tank 48 and waste tank 50 or on the inside surface of the formalin tank 48 or waste tank 50 and may be any type of float or other type of sensors capable of determining the level of a liquid arranged therein. The remote warning system 168 also includes a methodology, wherein the remote access configuration 176 includes a report transmit frequency setting 178, the ability to set the remote server IP address and port 180 and the ability to enable or disable the remote access 182 for the grossing station 30. The methodology for controlling the remote server starts in block 184 and then enters block 186 and determines if the remote report is enabled. If it is enabled, the methodology enters block 188 and transmits the data files at every predetermined time interval at any preset frequency. The methodology then returns to block 186 and determines if the remote report is enabled. If the remote report is not enabled, it will return to block 186 of the methodology. The methodology is able to set the report transmit frequency at a predetermined set time, anywhere from one millisecond up to twenty four hours, the methodology may allow for the user to configure the grossing station 30 to be in contact with a remote server and send the necessary warnings and alarms to the grossing station 30 and/or the remote devices 170,172 connected to the remote warning system 168.

The grossing station 30 also may include a low cubic feet pre minute (CFM) warning system 190. The low CFM warning system 190 may monitor the air flow rate and allow the user of the grossing station 30 to input a lower threshold limit that may be used to set off an alarm if the CFM drops below the set predetermined low limit. The grossing station 30 of the present invention has integrated this feature within its onboard system controller. This may allow for better packaging and the integration of an averaging routine needed to reduce data fluctuations that are caused by the grossing stations exhaust ducting and geometry. Based on the required flow rates for the stations, the Reynolds number is calculated to show a significant amount of turbulence for a 600 CFM flow rate for example. Thus, an averaging algorithm is incorporated into the methodology of the low CFM warming system 190 of the grossing station 30 and is added to reduce the fluctuations and stabilize the data therein. This methodology may allow the grossing station 30 to track the level of turbulence a percent fluctuation value is then calculated and displayed on the grossing station monitor as an air flow turbulence indicator 192. The flow rate sensor 92 is arranged within the ducting of the grossing station 30 and may be arranged at any portion in the ducting to ensure that the air flow rate never drops below the minimum set by the user. In one contemplated embodiment, the minimum CFM set may be 150 with a ten second delay and a turbulence value of two. However, any other known CFM may be used anywhere from zero to three thousand. The methodology used to control the low CFM warning system 190 may include a CFM monitor configuration block 194 which may allow for the CFM minimum limit (CML) 196 to be set by the user. The configuration 194 may also allow for the system reaction delay (SRD) 198 to be programmed in a number of seconds to allow for a delay of the air flow dropping below the minimum in a predetermined time frame. In one contemplated embodiment, a ten second delay may be used, however any other delay may be used from milliseconds up to hours. The CFM monitor configuration, as found in the methodology, also may allow for the CFM monitor to be enabled or disabled 200 by the user of the grossing station 30. The CFM warning system methodology may include a CFM data averaging block 202, the CFM averaging data averaging block 202 may then enter block 204 and determine if the CFM monitor is enabled. If the CFM monitor is enabled, the methodology may enter block 206 and determine the average data over a preset duration of time. In one contemplated embodiment, the average duration of time is approximately five hundred milliseconds. However, it should be noted that any other duration of time may be used. The methodology may then enter block 208 and save the data as a CFM reading and then return to block 204. If in block 204 the CFM monitor is determined not to be enabled, the methodology may return to block 204. A low CFM warning system 190 also has a methodology routine of a CFM monitor 210. The methodology enters block 212 and determines if the CFM monitor is enabled. If the CFM monitor is enabled, the methodology may enter block 214 and determine if the CFM is less than the CML over a period longer than the SRD. If the CFM is less than CML over a period longer than the SRD, the methodology may enter block 216 and turn the alarm on. The methodology may then return to block 212 of the methodology. If the CFM monitor is not enabled, the methodology may return to block 212 of the methodology. If in block 214 the CFM is greater than the CML over a period longer than the SRD, the methodology may return to block 212 and continue on. Therefore, the grossing station 30 of the present invention may have an air flow rate system that includes an air flow rate meter and allows for a low CFM warning to be audibly sounded and sent remotely to other users to indicate the low air flow rate within the grossing station 30. Alarms may be either shrill audible alarms and/or flashing lights, or a combination of both. The alarms 216 may be arranged directly on the grossing station 30, such as a speaker and associated lights may be arranged in the vicinity of the grossing station 30 on walls within the lab or the like or on remote devices.

The grossing station 30 also may include within its electronic control and monitoring system controller, GS1 software that may allow for the user to configure the warnings and alarms to their predetermined or preferred requirements. This may allow for the alarms 216 that are not desirable to be easily turned off and to be put into an off or not active position. The grossing station 30 of the present invention may allow for the flexibility and configurability of the alarms 216 over those of the prior art, where the prior art grossing stations all have fixed alarm systems. Thus, the user of the grossing station 30 may be able to have an audible alarm configuration and may be capable of turning off any alarm 216 for the formalin container, the waste container, the air filter of the grossing station, and for the low CFM of the grossing station 30. It should be noted that both the air flow rate meter and the audible alarm configuration system may be arranged anywhere on the table, walls, hood, of the grossing station 30 and may include the necessary touch buttons or knobs to allow for the configuration of the alarm system directly on the grossing station 30. It should be noted that it may also be remotely controlled, both the air flow rate meter and the audible alarm configuration, via a wired or wireless system. The alarm system methodology 218 may enter block 220 and determine if the alarm feature is enabled. If the alarm feature is enabled, the methodology may enter block 222 and determine if an alarm trigger condition is set to true. If the alarm trigger condition is set to true, the alarm system methodology may enter block 224 and enable the alarm 216 for the corresponding feature of the grossing station 30. The methodology may then return to block 220 of the methodology. If it is determined in block 220 that a feature alarm is not enabled, the methodology may return to block 220 of the methodology. If in block 222 the alarm trigger condition is not true, the methodology may exit and return to block 220 of the methodology. The methodology also controls the alarms 216. The methodology enters block 226 and determines if the alarm trigger is on. If the alarm trigger is on, the methodology may enter block 230 and display a visual warning. The methodology may then enter block 232 to determine if the mute for the alarm has been enabled. If the mute has not been enabled, the methodology may enter block 234 and sound the alarm. The methodology may then return to block 226 to continue the methodology. If in block 226 the methodology determines that the alarm trigger is not on, the methodology may enter block 228 and disable the mute button and then return to block 226 of the methodology. If in block 232 the methodology determines that the mute is enabled, the methodology may return to block 226 of the methodology.

The grossing station 30 of the present invention may also include an electrical system that needs to use a touch screen controller 236, which uses a higher level of complexity. The controller and devices used for the grossing station 30 are generally industrial grade with high mean time between failure values. However, like any other product, a failure is always possible even in grossing stations and to improve the system robustness, a manual redundancy is added into the grossing station 30 of the present invention to allow the user to manually operate the different features of the grossing station 30 in the event of a system or controller failure. With the redundancies built into the grossing station 30 of the present invention via the use of being able to manually operate the different features of the grossing station 30 allows for a more robust and reliable grossing station 30 for use in the work environment. As shown in the figures, a manual toggle switch 238 is generally used to bypass and control the different grossing station bus systems within the controller 236 if a system failure has occurred within the controller of the grossing station 30. As shown, the manual toggle switches 238 may allow for station lighting to be used, station ventilation to be used, the water system to be used and for the formalin system to be used, etc. Thus, a touch controller 236 may be arranged on any surface of the grossing station 30, including but not limited to, the table 52, the base 32, the walls, or the hood 70, to allow for overriding of the electrical controller system given a failure of that system, to allow for manual operation of the different features of the grossing station 30. Any type of touch pad may be used for both the touch controller 236 of the manual override system and the alarm system and low CFM warning system. It should be noted that the electrical circuitry used to operate and control each, is well known in the art. The methodology 240 used to control the redundant controls generally may enter block 242 and determine if the manual switch is in auto mode. If the manual switch is not in auto mode, the methodology may enter block 246 where the operator may control the features manually. If the manual switch in block 242 is in the automatic mode, the methodology may enter block 244 and the controller controls the features automatically. Therefore, the reliability is greatly increased with the grossing station 30 due to the fact that manual overriding may be used to operate different features of the grossing station 30 in the event of a controller or system failure of the grossing station 30.

The grossing station 30 of the present invention also includes an improved lighting system 248. The grossing station lighting system 248 may include improved strategies that focus on the light temperature (color), the work area light coverage and shadow reduction as they impact the grossing station user's experience. The grossing station 30 of the present invention generally may include three lights 250 arranged at predetermined positions in the hood 70 of the grossing station 30. However, it should be noted that any other number of lights anywhere from one to fifty, may be used in the grossing station 30 depending on the environment and size of the grossing station 30 according to the present invention. The lighting system 248 of the present invention may have the grossing station lights 250 arranged at predetermined intervals along the hood 70 of the grossing station 30. The following configurations also may be used with regard to the stations lights 250 based on the parameters described herein. The light reflector diameter 252 may be approximately seven inches the light view angle 254 may be approximately sixty degrees. It should be noted that the light reflector diameter 252 may be anywhere from one inch to forty eight inches, but in the embodiment shown herein, the approximate seven inch diameter is used. It should be noted that seven inches plus or minus one inch generally is the preferred embodiment. The lighting system 248 may also have a preferred light view angle of approximately sixty degrees, plus or minus five degrees, however any other light view angle may be used anywhere from one degree to one hundred eighty degrees depending on the system. The lighting configuration system 248 also may use light spacing 256 of approximately eighteen inches center to center from the LED lights used therein, with a plus or minus variation of two inches. However, it should be noted that the light spacing 256 may be anywhere from one inch up to forty eight inches, depending on the size and environment in which the grossing station 30 may be used. The lighting system 248 may also include the parameter of the light distance to work area of approximately thirty four inches plus or minus two inches in the preferred embodiment. However, any other known light distance to work area may be used from one inch up to one hundred inches, depending on the intensity of the lights and the design of the grossing station 30 therein. It should further be noted that the lighting system 248 may include the parameter of a light temperature of approximately 5000K to 5500K. However, it should be noted that any other light temperature anywhere from 5K to 20,000K may be used depending on the environment in which the grossing station 30 is used. The preferred configuration as described above generally may provide double the light coverage at the center work area 258 as shown in the figures. This double light coverage at the center work area 258 along with the use of large seven inch LED reflectors and diffusers may make the grossing station light very effective across the entire work surface with a reduction in shadow due to the dual coverage from two different light sources at any one position in the work area. It should be noted that LED lights are preferred to be used on the grossing station lighting system 248 however any other type of light, such as CFL, incandescent bulbs, or any other known light bulb may be used in the grossing station 30. It should be noted that any type of bulbs, such as tube bulbs, circular bulbs or any other type of bulb or reflector may also be used according to the present invention. The LED lights may have circular reflectors, but they may also have rectangular reflectors and may include circular bulbs or tube bulbs, or any other shaped LED bulbs and reflectors. With an increased lighted work area, more efficient autopsy procedures may be able to be conducted with the grossing station 30 according to the present invention. It should further be noted that all of the necessary electrical wiring maybe run through the hood 70, table 52, base 32, etc. and connect to the LED lights 250 in any manner known in the prior art. The lighting switch also maybe arranged anywhere on either the table, the base, the walls or the hood of the grossing station 30 to allow for an ergonomically positioned light switch to allow for easy on/off of the lights according to the present invention. It is also contemplated to use dimmers and timers on the lights 250 to allow for the lights to be on for a predetermined amount of time and to adjust the power of the light to allow for a proper light level to be used during the autopsy procedure.

The grossing station 30 of the present invention may also use a unique formalin refill system 260. Many prior art grossing stations use formalin tanks with a pump to dispense formalin when needed. A warning indicator is often used to warn the user that the tank is empty. Refilling the tank is currently a manual process involving the pouring of formalin into the grossing station's formalin container. The formalin refill system 260, according to the grossing station 30 of the present invention, allows for a user to use a large formalin drum 262 equipped with a refill pump 264 that may be used to refill multiple grossing stations 30. Generally, in one contemplated embodiment, the formalin drum 262 is a large fifty five gallon drum or equivalent and is placed and secured on a cart 266 that has wheels 268 that make the cart 266 capable of being pushed from station to station. It should be noted drum 262 may have any size from one gallon to one thousand gallons. It should be noted that the cart 266 generally has a base and a handle 270 attached thereto with wheels 268 generally located on the bottom portion of the base, thus allowing for the cart 266 to be pushed to any known position within a laboratory to allow for refilling of the formalin in the grossing stations 30. In operation, the operator of the formalin refill system 260 may plug the refill hose 272 into the grossing station formalin tank 48 and plug the refill power cord 274 into the refill outlet 276 which is arranged on the grossing station 30. The tank 48 is then refilled on the grossing station 30 with formalin until it is full. It should be noted that once the tank 48 is full, the formalin refill outlet 276 may automatically shut off preventing overfill and overflow of the formalin tank 48 within the grossing station. It should be noted that any type of refill hose 274 and associated valve maybe connected to the top or other portion of the formalin refill drum 262. The large formalin refill drum 262 generally has a pump 264 arranged at a top portion thereof, wherein the pump 264 is connected to a hose 272 on one end while hose 272 is connected to the formalin tank 48 of the grossing station 30 on the other end. The pump 264 is controlled electrically by a motor, which is also arranged at or near a top end of the formalin drum 262. The pump 264 may have the necessary electrical cord 274 attached thereto to power the pump 264 when the electrical cord 274 is specifically plugged 274 into a formalin refill outlet 276, which is arranged on a grossing station 30. The formalin refill outlet 276 on the grossing station 30 may allow for power to be passed through the formalin refill outlet 276 to the refill pump 264 until the formalin tank 48 reaches a full position, then power is cut to the refill outlet 276, thus cutting power to the pump 264 and allowing for the formalin not to overflow and leave the formalin tank 48 completely full. The formalin tank 48 arranged on the grossing station 30 may include a sensor 174 which determines the level of formalin therein and a hose valve 175 to which the refill hose 272 from the formalin drum 262 may be connected thereto in a secure manner. This may allow for the formalin to flow from the large formalin drum 262 into the formalin tank 48 of the grossing station 30. The formalin refill outlet 276 is arranged anywhere on the base 32, table 52, walls or hood 70 of the grossing station 30. It is electrically connected to the electronic control and monitoring system controller and it is also electrically connected to the formalin sensor 174 in the formalin tank 48. Hence, when the formalin sensor 174 reaches its full reading it will switch the power switch to the formalin refill outlet 276 to off, thus stopping power to the formalin refill outlet 276 and hence, the refill pump 264 arranged on the formalin drum 262. The methodology to control such formalin refill 278 of the grossing station 30 may enter block 280 and determine if the formalin drum 48 is full. If the formalin drum is full, the methodology enters block 282 and disables the formalin refill outlet 276 by turning power to the outlet off. If in block 280 it is determined that the formalin drum is not full, the methodology may enter block 284 and keep the formalin refill outlet 276 enabled, thus allowing power to flow to the refill pump 264 on the formalin replacement drum 262. The methodology also is used to control the formalin refill system on the refill side 286 may enter block 288 and determine if the power is on to the formalin refill outlet 276. If the power is on, the methodology may enter block 290 and the formalin pump 264 may keep pumping formalin into the grossing station formalin tank 48. If in block 288 the methodology determines that the power to the formalin refill outlet is not on but off, the methodology may enter block 292 and turn the pump off and the pump will not run, thus not allowing any formalin to flow from the large storage drum 262 into the formalin tank 48 of the grossing station 30. It should be noted that all of the necessary electrical circuitry is arranged on the controller and in the electronics of the grossing station 30 to allow for the automatic turning on and off of the formalin refill outlet 276 during formalin refill of the grossing station 30. The formalin refill system 260 of the grossing station 30 of the present invention includes the ability to easily refill multiple stations on one trip and reduce formalin exposure due to the automatic turning on and off of the refill system electronically.

The present description is for illustrative purposes only and it should not be construed to limit the present invention in any way. Thus, a person skilled in the art will appreciate that various modifications might be made to the present and disclosed embodiments without departing from the scope and spirit of the present invention, which is defined in terms of the claims below. Other aspects, features, and advantages may be apparent upon an examination of the attached drawing figures and appended claims.

What is claimed is:

1. A grossing station; said station comprising:
a table;
an overhead hood connected to said table;
a plurality of interchangeable plates arranged in a trough of said table;
a lift system connected to said table; and
an electronic control and monitoring system in communication with predetermined components of the grossing station; and
an air flow rate warning system having an air flow turbulence indicator.

2. The grossing station of claim 1, wherein said predetermined components are
a touch screen controller, an alarm system and a LED light system of the grossing station.

3. The grossing station of claim 2 wherein said touch screen controller arranged on a surface of the station, said touch screen controller in communication with at least one manual toggle switch for overriding said electronic control and monitoring system if a system failure occurs, said manual toggle switch controls lights of the station, ventilation of the station, water for the station or a formalin system of the station.

4. The grossing station of claim 2 wherein said alarm system allows a user to turn off any warning or alarm not needed for a predetermined autopsy, necropsy or pathology procedure.

5. The grossing station of claim 2 wherein said LED light system arranged in a surface of said hood, said LED light system having a plurality of LED light fixtures, said light fixtures improve light temperature, work area light coverage and shadow reduction for the station.

6. The grossing station of claim 5 wherein said LED light fixtures having an approximate seven inch diameter reflector, a single LED array source, an approximate sixty degree viewing angle, an approximate eighteen inch spacing between said LED light fixtures and said light temperature in a range of approximately 5000K to 5500K.

7. The grossing station of claim 1 further comprising a filter hour meter, said filter hour meter is a configurable and flow-based meter, a filter use is recorded only when air flow reaches said filter.

8. The grossing station of claim 7 further comprising a flow sensor in electrical communication with said filter hour meter and an on/off switch in electrical communication with a blower.

9. The grossing station of claim 7 wherein said filter hour meter is configured by a user to have a u air flow limit in order to begin recording of said filter use.

10. The grossing station of claim 1 further comprising an eco mode system, said eco mode system detects a presence of an individual in proximity to the station.

11. The grossing station of claim 10 wherein said eco mode system having a motion detection sensor arranged on a surface of the station.

12. The grossing station of claim 10 wherein said eco mode system having a user set length of time, said eco mode system turns off lights and ventilation of the station when the station is left unused for said user set length of time.

13. The grossing station of claim 1 further comprising a remote warning system, said remote warning system monitors a formalin tank and a waste tank, said remote warning system displays a warning indicator if said formalin tank is empty or if said waste tank is full.

14. The grossing station of claim 13 wherein said remote warning system sends said warning indicator to a remote server or electronic device, said remote warning system monitors a filter replacement system and an air flow monitor.

15. The grossing station of claim 1 further comprising an air flow rate warning system arranged with said electronic control and monitoring system, said air flow warning system having a predetermined low threshold limit for an air flow rate.

16. The grossing station of claim 1 further comprising an air flow rate meter.

17. The grossing station of claim 1 further comprising a formalin refill system, said formalin refill system comprising:

a formalin container;

a cart with wheels or rollers, said formalin container is arranged on said cart;

a refill pump arranged on said formalin container;

a refill hose connected to said refill pump; and a refill pump power cord connected to said refill pump.

18. The grossing station of claim 17 further comprising a refill electric outlet arranged on the station, said refill pump power cord plugs into said refill electric outlet during refilling of a formalin tank arranged on the station.

19. The grossing station of claim 18 wherein said refill electric outlet automatically turns off when said formalin tank is full.

20. A method of controlling a grossing station, said method comprising the steps of:

initializing an electronic control and monitoring system;

configuring a filter hour meter;

configuring an eco mode system;

configuring a remote warning system;

configuring a low air flow warning system, said low air flow warning system having an air flow turbulence indicator;

configuring an alarm system; and determining if a manual override is needed.

* * * * *